US012778262B2

(12) United States Patent
Salguero et al.

(10) Patent No.: US 12,778,262 B2
(45) Date of Patent: Nov. 3, 2026

(54) BRUSH ATTACHMENT FOR HAIR CARE APPLIANCE

(71) Applicant: SharkNinja Operating LLC, Needham, MA (US)

(72) Inventors: Victor Salguero, Waltham, MA (US); Shannon McSweeney, South Boston, MA (US)

(73) Assignee: SharkNinja Operating LLC, Needham, MA (US)

( * ) Notice: Subject to any disclaimer, the term of this patent is extended or adjusted under 35 U.S.C. 154(b) by 574 days.

(21) Appl. No.: 18/185,616

(22) Filed: Mar. 17, 2023

(65) Prior Publication Data

US 2024/0306788 A1 Sep. 19, 2024

(51) Int. Cl.
*A45D 20/52* (2006.01)
*A45D 20/12* (2006.01)

(52) U.S. Cl.
CPC ..... *A45D 20/525* (2013.01); *A45D 20/122* (2013.01)

(58) Field of Classification Search
CPC .... A45D 20/52; A45D 20/525; A45D 20/122; A45D 20/48; A45D 20/50; A45D 6/04; A45D 6/00; A45D 6/02; A45D 2002/003; A45D 2002/005; A45D 2002/006; A45D 2001/002; A45D 1/02; A45D 1/04; A45D 1/06; A45D 1/10; A45D 1/08; A45D 1/00; A45D 1/16; A45D 2/367; A45D 2/36;

(Continued)

(56) References Cited

U.S. PATENT DOCUMENTS 4,430,808 A 2/1984 Toyomi et al.
6,895,975 B2 5/2005 Hafemann
6,996,916 B2 2/2006 Cafaro
(Continued)

FOREIGN PATENT DOCUMENTS

AU 2011342980 B2 7/2014
AU 2011298168 B2 2/2015
(Continued)

OTHER PUBLICATIONS

Clarivate Analytics copyrighted translation of WO2013/014093; international filing date: Jul. 20, 2012 (Year: 2012).*
(Continued)

*Primary Examiner* — Rachel R Steitz
*Assistant Examiner* — Sarah Woodhouse
(74) *Attorney, Agent, or Firm* — Mintz, Levin, Cohn, Ferris, Glovsky and Popeo, P.C.

(57) ABSTRACT

An attachment for a hair care appliance is provided and can include an elongated body extending between proximal and distal ends, an air inlet at the proximal end, a fluid flow path extending from the air inlet toward the distal end, a plurality of air outlets for allowing air to exit the body, and a plurality of bristles extending from the body. The attachment can also include a baffle disposed within the body along the fluid flow path. The baffle can divert air received at the air inlet to the plurality of air outlets. The baffle can have a proximal region configured to reduce a volume of fluid along the fluid flow path and to radially distribute the fluid within the body, a distal region configured to increase an air pressure of the fluid, and an intermediate region configured to reduce air pressure provided to the distal region.

20 Claims, 12 Drawing Sheets

(58) Field of Classification Search
CPC ... A45D 2/00; A45D 2/02; A45D 2/04; A45D 2/12
See application file for complete search history.

(56) References Cited

U.S. PATENT DOCUMENTS

| | | | |
|---|---|---|---|
| 7,040,037 | B2 | 5/2006 | Keong |
| 7,661,174 | B2 | 2/2010 | Park |
| 8,066,017 | B1 | 11/2011 | Born et al. |
| 8,209,877 | B2 | 7/2012 | Smal |
| 8,407,913 | B2 | 4/2013 | Langley et al. |
| 8,602,038 | B2 | 12/2013 | Choi |
| D715,995 | S | 10/2014 | Dyson et al. |
| D715,996 | S | 10/2014 | Dyson et al. |
| D716,492 | S | 10/2014 | Dyson et al. |
| 8,869,808 | B2 | 10/2014 | De Benedictis |
| D729,447 | S | 5/2015 | Gammack |
| D729,448 | S | 5/2015 | Gammack |
| D729,978 | S | 5/2015 | Bates et al. |
| D729,979 | S | 5/2015 | Gammack |
| D730,575 | S | 5/2015 | Bates et al. |
| D730,576 | S | 5/2015 | Gammack |
| 9,027,570 | B2 | 5/2015 | De Benedictis et al. |
| D731,117 | S | 6/2015 | Bates et al. |
| 9,144,286 | B2 | 9/2015 | Courtney et al. |
| D741,544 | S | 10/2015 | Gammack |
| 9,173,468 | B2 | 11/2015 | Moloney et al. |
| 9,237,789 | B2 | 1/2016 | Prehodka |
| 9,282,799 | B2 | 3/2016 | Courtney et al. |
| 9,282,800 | B2 | 3/2016 | Courtney et al. |
| D757,361 | S | 5/2016 | Gammack |
| D757,362 | S | 5/2016 | Dyson et al. |
| D758,010 | S | 5/2016 | Bates et al. |
| D758,011 | S | 5/2016 | Gammack |
| D758,012 | S | 5/2016 | Bates et al. |
| 9,414,662 | B2 | 8/2016 | Moloney et al. |
| 9,420,864 | B2 | 8/2016 | Gammack et al. |
| 9,510,395 | B2 | 11/2016 | Coulton et al. |
| D775,419 | S | 12/2016 | Stephens et al. |
| 9,516,938 | B2 | 12/2016 | Richmond et al. |
| 9,526,310 | B2 | 12/2016 | Courtney et al. |
| 9,578,943 | B2 | 2/2017 | Guy-rabi et al. |
| 9,578,945 | B2 | 2/2017 | Han |
| D782,731 | S | 3/2017 | Smith et al. |
| D782,732 | S | 3/2017 | Smith et al. |
| D782,733 | S | 3/2017 | Smith et al. |
| D782,735 | S | 3/2017 | Stephens et al. |
| D782,736 | S | 3/2017 | Stephens et al. |
| 9,591,906 | B2 | 3/2017 | Guy-rabi et al. |
| 9,596,916 | B2 | 3/2017 | Moloney et al. |
| D784,614 | S | 4/2017 | Stephens et al. |
| D785,240 | S | 4/2017 | Smith et al. |
| D785,241 | S | 4/2017 | Stephens et al. |
| 9,629,434 | B2 | 4/2017 | Debenedictis et al. |
| 9,675,157 | B2 | 6/2017 | Courtney et al. |
| 9,687,058 | B2 | 6/2017 | Atkinson |
| D791,407 | S | 7/2017 | Smith et al. |
| D798,502 | S | 9/2017 | Smith et al. |
| 9,788,625 | B2 | 10/2017 | De Benedictis et al. |
| 9,808,061 | B2 | 11/2017 | Ford et al. |
| 9,808,065 | B2 | 11/2017 | Moloney et al. |
| 9,808,067 | B2 | 11/2017 | Sutter et al. |
| 9,854,891 | B2 | 1/2018 | De Benedictis |
| 9,877,562 | B2 | 1/2018 | Guy-rabi et al. |
| D811,009 | S | 2/2018 | Smith et al. |
| 9,936,788 | B2 | 4/2018 | Stephens et al. |
| 9,936,789 | B2 | 4/2018 | Stephens et al. |
| D817,007 | S | 5/2018 | Guy-rabi et al. |
| 10,010,150 | B2 | 7/2018 | Courtney et al. |
| 10,016,040 | B2 | 7/2018 | Courtney et al. |
| 10,021,951 | B2 | 7/2018 | Bobillier et al. |
| 10,064,470 | B2 | 9/2018 | Warne |
| D830,630 | S | 10/2018 | Chia et al. |
| 10,085,537 | B2 | 10/2018 | Maclaine |
| 10,085,538 | B2 | 10/2018 | Saunders et al. |
| 10,117,491 | B2 | 11/2018 | Moloney et al. |
| 10,143,285 | B2 | 12/2018 | Stephens et al. |
| 10,165,843 | B2 | 1/2019 | Hedges |
| 10,165,844 | B2 | 1/2019 | Stephens et al. |
| 10,186,822 | B2 | 1/2019 | Hogan |
| 10,194,728 | B2 | 2/2019 | Stephens et al. |
| 10,213,001 | B2 | 2/2019 | Stephens et al. |
| D843,652 | S | 3/2019 | Mcluckie et al. |
| D843,653 | S | 3/2019 | Teyu et al. |
| D843,654 | S | 3/2019 | Teyu et al. |
| 10,226,112 | B2 | 3/2019 | Kerr et al. |
| 10,238,199 | B2 | 3/2019 | Stephens et al. |
| D847,421 | S | 4/2019 | Tappenden et al. |
| D847,422 | S | 4/2019 | Tappenden et al. |
| D847,423 | S | 4/2019 | Tappenden et al. |
| D847,424 | S | 4/2019 | Tappenden et al. |
| D847,425 | S | 4/2019 | Tappenden et al. |
| D847,426 | S | 4/2019 | Tappenden et al. |
| D848,063 | S | 5/2019 | Tappenden et al. |
| D848,064 | S | 5/2019 | Tappenden et al. |
| D848,065 | S | 5/2019 | Heffer et al. |
| D848,066 | S | 5/2019 | Coulton et al. |
| D848,067 | S | 5/2019 | Heffer et al. |
| D848,068 | S | 5/2019 | Heffer et al. |
| D848,675 | S | 5/2019 | Chia et al. |
| D850,001 | S | 5/2019 | Coulton et al. |
| 10,278,471 | B2 | 5/2019 | Shelton et al. |
| D852,415 | S | 6/2019 | Coulton et al. |
| D852,416 | S | 6/2019 | Coulton et al. |
| 10,306,965 | B2 | 6/2019 | Wilkinson et al. |
| D853,637 | S | 7/2019 | Coulton et al. |
| D853,638 | S | 7/2019 | Tappenden et al. |
| D853,639 | S | 7/2019 | Tappenden et al. |
| D853,640 | S | 7/2019 | Tappenden et al. |
| D853,641 | S | 7/2019 | Tappenden et al. |
| D853,642 | S | 7/2019 | Coulton et al. |
| D854,745 | S | 7/2019 | Chia et al. |
| D855,252 | S | 7/2019 | Coulton et al. |
| D856,579 | S | 8/2019 | Chia et al. |
| D856,580 | S | 8/2019 | Chia et al. |
| 10,383,422 | B2 | 8/2019 | Law et al. |
| 10,390,599 | B1 | 8/2019 | James et al. |
| D860,528 | S | 9/2019 | Atkinson et al. |
| D860,529 | S | 9/2019 | Atkinson et al. |
| D860,530 | S | 9/2019 | Atkinson et al. |
| D860,531 | S | 9/2019 | Atkinson et al. |
| D860,532 | S | 9/2019 | Atkinson et al. |
| D865,286 | S | 10/2019 | Atkinson et al. |
| 10,441,049 | B2 | 10/2019 | Douglas et al. |
| 10,441,050 | B2 | 10/2019 | Blanc et al. |
| 10,448,722 | B2 | 10/2019 | Mcluckie |
| 10,470,545 | B2 | 11/2019 | Thiebaut et al. |
| D869,763 | S | 12/2019 | Atkinson et al. |
| D869,764 | S | 12/2019 | Atkinson et al. |
| 10,575,617 | B2 | 3/2020 | Courtney et al. |
| 10,582,751 | B2 | 3/2020 | Courtney |
| 10,602,826 | B2 | 3/2020 | Wilkinson et al. |
| 10,610,000 | B2 | 4/2020 | Courtney et al. |
| D884,966 | S | 5/2020 | Flynn et al. |
| D885,663 | S | 5/2020 | Flynn et al. |
| 10,660,417 | B2 | 5/2020 | Bennett |
| 10,660,418 | B2 | 5/2020 | Degrood et al. |
| 10,687,595 | B2 | 6/2020 | Courtney et al. |
| 10,729,218 | B2 | 8/2020 | Childe et al. |
| 10,765,191 | B2 | 9/2020 | Stephens et al. |
| 10,786,061 | B2 | 9/2020 | Thiebaut et al. |
| 10,849,400 | B2 | 12/2020 | Weatherly et al. |
| 10,869,529 | B2 | 12/2020 | Chia et al. |
| 10,874,186 | B2 | 12/2020 | Macpherson et al. |
| 10,973,298 | B2 | 4/2021 | Kennedy et al. |
| D923,874 | S | 6/2021 | Kirkbride et al. |
| 11,033,088 | B2 | 6/2021 | Atkinson et al. |
| 11,044,979 | B2 | 6/2021 | Maclaine |
| 11,071,365 | B2 | 7/2021 | Maclaine et al. |
| 11,168,924 | B2 | 11/2021 | Naicker et al. |
| 11,172,745 | B2 | 11/2021 | Tam et al. |
| 11,296,621 | B2 | 4/2022 | Zheng et al. |
| 11,330,884 | B2 | 5/2022 | Degrood et al. |
| 11,589,660 | B2 | 2/2023 | Thompson et al. |

(56) References Cited

U.S. PATENT DOCUMENTS

| | | | | |
|---|---|---|---|---|
| 11,589,661 | B2 | 2/2023 | Guerreiro et al. | |
| 2014/0366910 | A1* | 12/2014 | Habibi | F16H 21/50 15/160 |
| 2016/0262518 | A1 | 9/2016 | Guy-rabi et al. | |
| 2017/0196333 | A1* | 7/2017 | Leung | A45D 2/12 |
| 2017/0273428 | A1 | 9/2017 | Nicolson et al. | |
| 2017/0273429 | A1 | 9/2017 | Nicolson et al. | |
| 2017/0310249 | A1 | 10/2017 | Zheng et al. | |
| 2018/0055182 | A1 | 3/2018 | Thompson et al. | |
| 2019/0223572 | A1 | 7/2019 | Ahrens | |
| 2019/0357653 | A1 | 11/2019 | Guerreiro et al. | |
| 2019/0380463 | A1 | 12/2019 | Guerreiro et al. | |
| 2020/0037725 | A1 | 2/2020 | Ahrens | |
| 2020/0085163 | A1 | 3/2020 | James et al. | |
| 2020/0237070 | A1 | 7/2020 | Degrood et al. | |
| 2020/0397111 | A1 | 12/2020 | Bouchar | |
| 2020/0397113 | A1* | 12/2020 | Hillebrecht | B25G 3/18 |
| 2021/0000237 | A1 | 1/2021 | Kennedy et al. | |
| 2021/0285328 | A1 | 9/2021 | Mahmoodilari et al. | |
| 2021/0381527 | A1 | 12/2021 | Peet et al. | |
| 2022/0190751 | A1 | 6/2022 | Zheng et al. | |

FOREIGN PATENT DOCUMENTS

| | | | |
|---|---|---|---|
| AU | 2013239504 | B2 | 4/2015 |
| AU | 2013239510 | B2 | 10/2015 |
| AU | 2013285200 | B2 | 11/2015 |
| AU | 2013285201 | B2 | 1/2016 |
| AU | 2014202857 | B2 | 8/2016 |
| AU | 2014389903 | A1 | 9/2016 |
| AU | 2013283014 | B2 | 2/2017 |
| AU | 2014285903 | B2 | 2/2017 |
| AU | 2013261059 | B2 | 5/2017 |
| AU | 2014285903 | C1 | 5/2017 |
| AU | 201714987 | S | 9/2017 |
| AU | 201714988 | S | 9/2017 |
| AU | 2015233175 | B2 | 9/2017 |
| AU | 201715704 | S | 10/2017 |
| AU | 201715709 | S | 10/2017 |
| AU | 201715713 | S | 10/2017 |
| AU | 201717218 | S | 12/2017 |
| AU | 201717219 | S | 12/2017 |
| AU | 201717220 | S | 12/2017 |
| AU | 201717221 | S | 12/2017 |
| AU | 201717222 | S | 12/2017 |
| AU | 201717232 | S | 12/2017 |
| AU | 201717235 | S | 12/2017 |
| AU | 201717236 | S | 12/2017 |
| AU | 201717237 | S | 12/2017 |
| AU | 201717246 | S | 12/2017 |
| AU | 2015233174 | B2 | 12/2017 |
| AU | 201810343 | S | 2/2018 |
| AU | 201810344 | S | 2/2018 |
| AU | 201810345 | S | 2/2018 |
| AU | 201810346 | S | 2/2018 |
| AU | 201810348 | S | 2/2018 |
| AU | 201810466 | S | 2/2018 |
| AU | 201810467 | S | 2/2018 |
| AU | 201810472 | S | 2/2018 |
| AU | 2017101822 | A4 | 2/2018 |
| AU | 201811153 | S | 3/2018 |
| AU | 201811154 | S | 3/2018 |
| AU | 201811828 | S | 4/2018 |
| AU | 2016277577 | B2 | 8/2018 |
| AU | 2018204763 | A1 | 1/2019 |
| AU | 2018201042 | B2 | 8/2019 |
| AU | 2017318546 | B2 | 7/2020 |
| AU | 2017393026 | B2 | 12/2020 |
| AU | 2018441457 | A1 | 4/2021 |
| CA | 2873465 | A1 | 11/2013 |
| CA | 2943399 | A1 | 9/2015 |
| CA | 3011101 | A1 | 1/2019 |
| CA | 3109771 | A1 | 3/2020 |
| CN | 101662969 | B | 8/2011 |
| CN | 203168302 | U | 9/2013 |
| CN | 203168303 | U | 9/2013 |
| CN | 203220053 | U | 10/2013 |
| CN | 203328162 | U | 12/2013 |
| CN | 203369521 | U | 1/2014 |
| CN | 203369522 | U | 1/2014 |
| CN | 203524054 | U | 4/2014 |
| CN | 101896091 | B | 8/2014 |
| CN | 104287408 | A | 1/2015 |
| CN | 204292438 | U | 4/2015 |
| CN | 204317818 | U | 5/2015 |
| CN | 204483371 | U | 7/2015 |
| CN | 204483372 | U | 7/2015 |
| CN | 204483373 | U | 7/2015 |
| CN | 204499778 | U | 7/2015 |
| CN | 104921436 | A | 9/2015 |
| CN | 104921437 | A | 9/2015 |
| CN | 104968235 | A | 10/2015 |
| CN | 204742992 | U | 11/2015 |
| CN | 204796991 | U | 11/2015 |
| CN | 204796992 | U | 11/2015 |
| CN | 103565076 | B | 12/2015 |
| CN | 105231630 | A | 1/2016 |
| CN | 103355925 | B | 2/2016 |
| CN | 103228170 | B | 3/2016 |
| CN | 103549750 | B | 3/2016 |
| CN | 105433576 | A | 3/2016 |
| CN | 103237475 | B | 5/2016 |
| CN | 102665479 | B | 7/2016 |
| CN | 103355930 | B | 8/2016 |
| CN | 103519541 | B | 8/2016 |
| CN | 205456831 | U | 8/2016 |
| CN | 106256283 | A | 12/2016 |
| CN | 106256286 | A | 12/2016 |
| CN | 205963257 | U | 2/2017 |
| CN | 205963258 | U | 2/2017 |
| CN | 103355927 | B | 3/2017 |
| CN | 205993856 | U | 3/2017 |
| CN | 206043777 | U | 3/2017 |
| CN | 206043778 | U | 3/2017 |
| CN | 206043779 | U | 3/2017 |
| CN | 103355926 | B | 4/2017 |
| CN | 103355928 | B | 4/2017 |
| CN | 103355929 | B | 4/2017 |
| CN | 103519540 | B | 4/2017 |
| CN | 206150740 | U | 5/2017 |
| CN | 206295038 | U | 7/2017 |
| CN | 206338218 | U | 7/2017 |
| CN | 206354632 | U | 7/2017 |
| CN | 107006989 | A | 8/2017 |
| CN | 206517192 | U | 9/2017 |
| CN | 107224080 | A | 10/2017 |
| CN | 206651501 | U | 11/2017 |
| CN | 206699677 | U | 12/2017 |
| CN | 206744836 | U | 12/2017 |
| CN | 104026843 | B | 1/2018 |
| CN | 104337192 | B | 1/2018 |
| CN | 104042020 | B | 2/2018 |
| CN | 207023591 | U | 2/2018 |
| CN | 207023592 | U | 2/2018 |
| CN | 104411205 | B | 3/2018 |
| CN | 107788666 | A | 3/2018 |
| CN | 104042022 | B | 4/2018 |
| CN | 207168088 | U | 4/2018 |
| CN | 207322932 | U | 5/2018 |
| CN | 207322933 | U | 5/2018 |
| CN | 207355685 | U | 5/2018 |
| CN | 104273921 | B | 6/2018 |
| CN | 108135342 | A | 6/2018 |
| CN | 207544575 | U | 6/2018 |
| CN | 207544576 | U | 6/2018 |
| CN | 108402637 | A | 8/2018 |
| CN | 108567216 | A | 9/2018 |
| CN | 207803715 | U | 9/2018 |
| CN | 104273917 | B | 10/2018 |
| CN | 104273919 | B | 10/2018 |
| CN | 104510138 | B | 10/2018 |
| CN | 207927983 | U | 10/2018 |
| CN | 207939324 | U | 10/2018 |

(56) References Cited

FOREIGN PATENT DOCUMENTS

| | | | | |
|---|---|---|---|---|
| CN | 104273920 | B | | 11/2018 |
| CN | 104510137 | B | | 11/2018 |
| CN | 208144697 | U | | 11/2018 |
| CN | 105392386 | A | | 12/2018 |
| CN | 108991700 | A | | 12/2018 |
| CN | 208339134 | U | | 1/2019 |
| CN | 104273918 | B | | 2/2019 |
| CN | 208463170 | U | | 2/2019 |
| CN | 208524016 | U | | 2/2019 |
| CN | 105559311 | B | | 4/2019 |
| CN | 106989039 | B | | 5/2019 |
| CN | 209073632 | U | | 7/2019 |
| CN | 104921435 | B | | 8/2019 |
| CN | 106256287 | B | | 8/2019 |
| CN | 110074535 | A | | 8/2019 |
| CN | 106165958 | B | | 9/2019 |
| CN | 106333459 | B | | 9/2019 |
| CN | 105639974 | B | | 10/2019 |
| CN | 110325073 | A | | 10/2019 |
| CN | 209573664 | U | | 11/2019 |
| CN | 110582215 | A | | 12/2019 |
| CN | 105473022 | B | | 2/2020 |
| CN | 210055005 | U | | 2/2020 |
| CN | 210055006 | U | | 2/2020 |
| CN | 106256282 | B | | 3/2020 |
| CN | 111202335 | A | | 5/2020 |
| CN | 105686301 | B | | 6/2020 |
| CN | 105795679 | B | | 6/2020 |
| CN | 111248594 | A | | 6/2020 |
| CN | 104042021 | B | | 7/2020 |
| CN | 111432684 | A | | 7/2020 |
| CN | 106820534 | B | | 8/2020 |
| CN | 211154233 | U | | 8/2020 |
| CN | 105407757 | B | | 10/2020 |
| CN | 106880155 | B | | 10/2020 |
| CN | 106974416 | B | | 10/2020 |
| CN | 211794793 | U | | 10/2020 |
| CN | 106974415 | B | | 11/2020 |
| CN | 107847031 | B | | 11/2020 |
| CN | 108206600 | B | | 11/2020 |
| CN | 211984215 | U | | 11/2020 |
| CN | 211984221 | U | | 11/2020 |
| CN | 108272207 | B | | 12/2020 |
| CN | 212185556 | U | | 12/2020 |
| CN | 112336037 | A | | 2/2021 |
| CN | 108618334 | B | | 4/2021 |
| CN | 106963093 | B | | 5/2021 |
| CN | 108618333 | B | | 5/2021 |
| CN | 213096652 | U | | 5/2021 |
| CN | 213215774 | U | | 5/2021 |
| CN | 106165959 | B | | 6/2021 |
| CN | 107224085 | B | | 6/2021 |
| CN | 107317521 | B | | 6/2021 |
| CN | 106256284 | B | | 7/2021 |
| CN | 113080592 | A | | 7/2021 |
| CN | 105407756 | B | | 8/2021 |
| CN | 106901482 | B | | 8/2021 |
| CN | 107224087 | B | | 8/2021 |
| CN | 107224077 | B | | 9/2021 |
| CN | 113437901 | A | | 9/2021 |
| CN | 109247685 | B | | 10/2021 |
| CN | 109788833 | B | | 11/2021 |
| CN | 113786051 | A | | 12/2021 |
| CN | 109674176 | B | | 3/2022 |
| CN | 108851461 | B | | 6/2022 |
| CN | 114680439 | A | | 7/2022 |
| CO | 6721018 | A2 | | 7/2013 |
| CR | 20130272 | A | | 1/2014 |
| DE | 2838587 | A | * | 3/1980 |
| EP | 1779745 | B1 | | 5/2008 |
| EP | 2242393 | B1 | | 4/2013 |
| EP | 2611329 | B1 | | 8/2014 |
| EP | 2736375 | B1 | | 9/2015 |
| EP | 2651260 | B1 | | 10/2015 |
| EP | 2745729 | B1 | | 11/2015 |
| EP | 2656746 | B1 | | 12/2015 |
| EP | 3119235 | A1 | | 1/2017 |
| EP | 3119236 | A1 | | 1/2017 |
| EP | 2975966 | B1 | | 4/2017 |
| EP | 2736374 | B1 | | 6/2017 |
| EP | 2863770 | B1 | | 6/2017 |
| EP | 2862476 | B1 | | 1/2018 |
| EP | 3324782 | A1 | | 5/2018 |
| EP | 2830462 | B1 | | 6/2018 |
| EP | 3016545 | B1 | | 6/2018 |
| EP | 3158890 | B1 | | 8/2018 |
| EP | 2849605 | B1 | | 10/2018 |
| EP | 3024352 | B1 | | 10/2018 |
| EP | 3240455 | B1 | | 11/2018 |
| EP | 3335586 | B1 | | 11/2018 |
| EP | 3206523 | B1 | | 12/2018 |
| EP | 3016541 | B1 | | 1/2019 |
| EP | 3235397 | B1 | | 2/2019 |
| EP | 3310207 | B1 | | 2/2019 |
| EP | 2611328 | B1 | | 3/2019 |
| EP | 3079521 | B1 | | 4/2019 |
| EP | 3172985 | B1 | | 4/2019 |
| EP | 3232853 | B1 | | 4/2019 |
| EP | 3016540 | B1 | | 5/2019 |
| EP | 3048926 | B1 | | 6/2019 |
| EP | 3048925 | B1 | | 7/2019 |
| EP | 3506786 | A1 | | 7/2019 |
| EP | 3512372 | A1 | | 7/2019 |
| EP | 3516986 | A1 | | 7/2019 |
| EP | 3364816 | B1 | | 10/2019 |
| EP | 3568038 | A1 | | 11/2019 |
| EP | 3568039 | A1 | | 11/2019 |
| EP | 2830457 | B1 | | 12/2019 |
| EP | 2830459 | B1 | | 12/2019 |
| EP | 2620075 | B2 | | 2/2020 |
| EP | 3622780 | A1 | | 3/2020 |
| EP | 2869726 | B1 | | 4/2020 |
| EP | 2869727 | B1 | | 4/2020 |
| EP | 3432759 | B1 | | 6/2020 |
| EP | 3016544 | B1 | | 7/2020 |
| EP | 3310204 | B1 | | 7/2020 |
| EP | 3687335 | A1 | | 8/2020 |
| EP | 3328237 | B1 | | 11/2020 |
| EP | 3319473 | B1 | | 2/2021 |
| EP | 3432757 | B1 | | 2/2021 |
| EP | 3119234 | B1 | | 11/2021 |
| EP | 3009027 | B2 | | 6/2022 |
| EP | 3849373 | A4 | | 6/2022 |
| EP | 3028596 | B1 | | 7/2022 |
| EP | 3427609 | B1 | | 9/2022 |
| EP | 4179916 | A1 | | 5/2023 |
| FR | 2493689 | A1 | * | 5/1982 |
| FR | 3039377 | B1 | | 9/2017 |
| GB | 2477834 | B | | 2/2012 |
| GB | 2455716 | C | | 2/2013 |
| GB | 2501175 | B | | 4/2014 |
| GB | 2500798 | B | | 5/2014 |
| GB | 2500800 | B | | 5/2014 |
| GB | 2501379 | B | | 5/2014 |
| GB | 2500801 | B | | 7/2014 |
| GB | 2511219 | B | | 5/2015 |
| GB | 2515809 | B | | 8/2015 |
| GB | 2515810 | B | | 11/2015 |
| GB | 2515811 | B | | 11/2015 |
| GB | 2515812 | B | | 2/2016 |
| GB | 2516478 | B | | 3/2016 |
| GB | 2518639 | B | | 3/2016 |
| GB | 201605028 | | | 5/2016 |
| GB | 2497057 | B | | 8/2016 |
| GB | 201612054 | | | 8/2016 |
| GB | 2531431 | B | | 11/2016 |
| GB | 2521144 | B | | 12/2016 |
| GB | 2526768 | B | | 2/2017 |
| GB | 2516249 | B | | 3/2017 |
| GB | 2503683 | B | | 4/2017 |
| GB | 2524304 | B | | 4/2017 |
| GB | 2526049 | B | | 4/2017 |
| GB | 2515813 | B | | 7/2017 |
| GB | 2543135 | B | | 11/2017 |

(56) References Cited

FOREIGN PATENT DOCUMENTS

| | | | | | |
|---|---|---|---|---|---|
| GB | 2533324 | B | | 12/2017 | |
| GB | 2503687 | B | | 2/2018 | |
| GB | 2547138 | B | | 3/2018 | |
| GB | 2534379 | B | | 5/2018 | |
| GB | 2545412 | B | | 6/2018 | |
| GB | 2539437 | B | | 7/2018 | |
| GB | 2540203 | B | | 7/2018 | |
| GB | 2551852 | B | | 9/2018 | |
| GB | 201818400 | | | 12/2018 | |
| GB | 2539432 | B | | 1/2019 | |
| GB | 2539441 | B | | 1/2019 | |
| GB | 2543536 | B | | 1/2019 | |
| GB | 2558415 | B | | 2/2019 | |
| GB | 2543751 | B | | 4/2019 | |
| GB | 2549740 | B | | 4/2019 | |
| GB | 2561093 | B | | 4/2019 | |
| GB | 2538560 | B | | 5/2019 | |
| GB | 2561094 | B | | 5/2019 | |
| GB | 2548822 | B | | 8/2019 | |
| GB | 2548816 | B | | 9/2019 | |
| GB | 2548812 | B | | 10/2019 | |
| GB | 2553516 | B | | 1/2020 | |
| GB | 2565698 | B | | 1/2020 | |
| GB | 2548616 | B | | 2/2020 | |
| GB | 2548813 | B | | 2/2020 | |
| GB | 2560888 | B | | 4/2020 | |
| GB | 2548819 | B | | 5/2020 | |
| GB | 2557958 | B | | 5/2020 | |
| GB | 2560889 | B | | 9/2020 | |
| GB | 2567661 | B | | 9/2020 | |
| GB | 202015444 | | | 11/2020 | |
| GB | 202015445 | | | 11/2020 | |
| GB | 202101269 | | | 3/2021 | |
| GB | 2562276 | B | | 4/2021 | |
| GB | 2576017 | B | | 4/2021 | |
| GB | 202102691 | | | 4/2021 | |
| GB | 2560356 | B | | 5/2021 | |
| GB | 2575297 | B | | 5/2021 | |
| GB | 2581371 | B | | 9/2021 | |
| GB | 2581372 | B | | 12/2021 | |
| GB | 2595974 | A | * | 12/2021 | ..... A46B 9/023 |
| GB | 2603174 | A | | 8/2022 | |
| GB | 2603175 | A | | 8/2022 | |
| GB | 2603176 | A | | 8/2022 | |
| GB | 2603177 | A | | 8/2022 | |
| GB | 2580416 | B | | 9/2022 | |
| JP | S4820685 | U | | 3/1973 | |
| JP | H1042932 | A | | 2/1998 | |
| JP | 2001527427 | A | | 12/2001 | |
| JP | 5361906 | B2 | | 9/2013 | |
| JP | 2013212383 | A | | 10/2013 | |
| JP | 2013212385 | A | | 10/2013 | |
| JP | 2013212387 | A | | 10/2013 | |
| JP | 2013212388 | A | | 10/2013 | |
| JP | 2014012142 | A | | 1/2014 | |
| JP | 2014012143 | A | | 1/2014 | |
| JP | 2014521444 | A | | 8/2014 | |
| JP | 5636441 | B2 | | 10/2014 | |
| JP | 2014217770 | A | | 11/2014 | |
| JP | 5674852 | B2 | | 1/2015 | |
| JP | 2015013124 | A | | 1/2015 | |
| JP | 2015013125 | A | | 1/2015 | |
| JP | 2015013127 | A | | 1/2015 | |
| JP | 2015023798 | A | | 2/2015 | |
| JP | 2015024137 | A | | 2/2015 | |
| JP | 5709926 | B2 | | 3/2015 | |
| JP | 5722403 | B2 | | 4/2015 | |
| JP | 2015066446 | A | | 4/2015 | |
| JP | 2015066447 | A | | 4/2015 | |
| JP | 2015097941 | A | | 5/2015 | |
| JP | 5758944 | B2 | | 6/2015 | |
| JP | 5760030 | B2 | | 6/2015 | |
| JP | 5780311 | B2 | | 7/2015 | |
| JP | 2015181946 | A | | 10/2015 | |
| JP | 2015181947 | A | | 10/2015 | |
| JP | 5897573 | B2 | | 3/2016 | |
| JP | 2016040008 | A | | 3/2016 | |
| JP | 5913465 | B2 | | 4/2016 | |
| JP | 5923062 | B2 | | 4/2016 | |
| JP | 2016083586 | A | | 5/2016 | |
| JP | 5953642 | B2 | | 6/2016 | |
| JP | 2016112423 | A | | 6/2016 | |
| JP | 2016112424 | A | | 6/2016 | |
| JP | 2016129688 | A | | 7/2016 | |
| JP | 2016129780 | A | | 7/2016 | |
| JP | 2016131890 | A | | 7/2016 | |
| JP | 5987256 | B2 | | 8/2016 | |
| JP | 5990839 | B2 | | 8/2016 | |
| JP | 2016523648 | A | | 8/2016 | |
| JP | 6008302 | B2 | | 9/2016 | |
| JP | 2016526429 | A | | 9/2016 | |
| JP | 6035635 | B2 | | 11/2016 | |
| JP | 6069773 | B2 | | 1/2017 | |
| JP | 2017006664 | A | | 1/2017 | |
| JP | 2017006665 | A | | 1/2017 | |
| JP | 2017006666 | A | | 1/2017 | |
| JP | 2017006668 | A | | 1/2017 | |
| JP | 2017012789 | A | | 1/2017 | |
| JP | 2017018593 | A | | 1/2017 | |
| JP | 2017502735 | A | | 1/2017 | |
| JP | 6085841 | B2 | | 2/2017 | |
| JP | 6129943 | B2 | | 4/2017 | |
| JP | 2017077470 | A | | 4/2017 | |
| JP | 2017077471 | A | | 4/2017 | |
| JP | 2017077472 | A | | 4/2017 | |
| JP | 2017079592 | A | | 4/2017 | |
| JP | 2017512589 | A | | 5/2017 | |
| JP | 6151226 | B2 | | 6/2017 | |
| JP | 6161762 | B2 | | 6/2017 | |
| JP | 2017140364 | A | | 8/2017 | |
| JP | 2017148598 | A | | 8/2017 | |
| JP | 6208265 | B2 | | 9/2017 | |
| JP | 2017170147 | A | | 9/2017 | |
| JP | 2017170149 | A | | 9/2017 | |
| JP | 2017170150 | A | | 9/2017 | |
| JP | 2017185217 | A | | 10/2017 | |
| JP | 6243455 | B2 | | 11/2017 | |
| JP | 2017200432 | A | | 11/2017 | |
| JP | 2017209536 | A | | 11/2017 | |
| JP | 6278854 | B2 | | 1/2018 | |
| JP | 6291523 | B2 | | 2/2018 | |
| JP | 6297958 | B2 | | 3/2018 | |
| JP | 2018033968 | A | | 3/2018 | |
| JP | 2018043010 | A | | 3/2018 | |
| JP | 6332918 | B2 | | 5/2018 | |
| JP | 6343633 | B2 | | 5/2018 | |
| JP | 6344570 | B2 | | 6/2018 | |
| JP | 2018086277 | A | | 6/2018 | |
| JP | 2018110514 | A | | 7/2018 | |
| JP | 6386547 | B2 | | 8/2018 | |
| JP | 6388217 | B2 | | 8/2018 | |
| JP | 2018134441 | A | | 8/2018 | |
| JP | 6416155 | B2 | | 10/2018 | |
| JP | 2018158110 | A | | 10/2018 | |
| JP | 2018158111 | A | | 10/2018 | |
| JP | 2018190728 | A | | 11/2018 | |
| JP | 6453829 | B2 | | 12/2018 | |
| JP | 6456879 | B2 | | 12/2018 | |
| JP | 6475261 | B2 | | 2/2019 | |
| JP | 6511080 | B2 | | 4/2019 | |
| JP | 6512713 | B2 | | 4/2019 | |
| JP | 6518281 | B2 | | 4/2019 | |
| JP | 6522914 | B2 | | 5/2019 | |
| JP | 6523157 | B2 | | 5/2019 | |
| JP | 6533480 | B2 | | 5/2019 | |
| JP | 2019076720 | A | | 5/2019 | |
| JP | 6538010 | B2 | | 6/2019 | |
| JP | 6542180 | B2 | | 6/2019 | |
| JP | 6556183 | B2 | | 7/2019 | |
| JP | 6557650 | B2 | | 7/2019 | |
| JP | 6557695 | B2 | | 7/2019 | |
| JP | 2019141560 | A | | 8/2019 | |
| JP | 6585115 | B2 | | 9/2019 | |
| JP | 6599917 | B2 | | 10/2019 | |

(56) References Cited

FOREIGN PATENT DOCUMENTS

| | | | |
|---|---|---|---|
| JP | 2019193568 | A | 10/2019 |
| JP | 6625527 | B2 | 12/2019 |
| JP | 6634296 | B2 | 12/2019 |
| JP | 6662936 | B2 | 2/2020 |
| JP | 2020505721 | A | 2/2020 |
| JP | 3225772 | U | 3/2020 |
| JP | 2020047605 | A | 3/2020 |
| JP | 3226032 | U | 4/2020 |
| JP | 6723287 | B2 | 6/2020 |
| JP | 6723961 | B2 | 6/2020 |
| JP | 6738839 | B2 | 7/2020 |
| JP | 2020099758 | A | 7/2020 |
| JP | 6779198 | B2 | 10/2020 |
| JP | 6792318 | B2 | 11/2020 |
| JP | 6811290 | B2 | 12/2020 |
| JP | 2020535860 | A | 12/2020 |
| JP | 6838006 | B2 | 2/2021 |
| JP | 6854109 | B2 | 3/2021 |
| JP | 6861790 | B2 | 4/2021 |
| JP | 6890571 | B2 | 5/2021 |
| JP | 2021087838 | A | 6/2021 |
| JP | 6924442 | B2 | 8/2021 |
| JP | 2021166822 | A | 10/2021 |
| JP | 2022509442 | A | 1/2022 |
| KR | 101196487 | B1 | 11/2012 |
| KR | 101229109 | B1 | 2/2013 |
| KR | 20140129309 | A | 11/2014 |
| KR | 20140129310 | A | 11/2014 |
| KR | 20140129322 | A | 11/2014 |
| KR | 20140129323 | A | 11/2014 |
| KR | 20140129324 | A | 11/2014 |
| KR | 101468416 | B1 | 12/2014 |
| KR | 20140138797 | A | 12/2014 |
| KR | 200475794 | Y1 | 1/2015 |
| KR | 20150023773 | A | 3/2015 |
| KR | 20150023774 | A | 3/2015 |
| KR | 20160020555 | A | 2/2016 |
| KR | 20160020556 | A | 2/2016 |
| KR | 20160020557 | A | 2/2016 |
| KR | 20160020558 | A | 2/2016 |
| KR | 20160021265 | A | 2/2016 |
| KR | 20160021294 | A | 2/2016 |
| KR | 20160021862 | A | 2/2016 |
| KR | 20160052719 | A | 5/2016 |
| KR | 20160052720 | A | 5/2016 |
| KR | 20160052721 | A | 5/2016 |
| KR | 20160075829 | A | 6/2016 |
| KR | 20160075831 | A | 6/2016 |
| KR | 20160079142 | A | 7/2016 |
| KR | 20160079144 | A | 7/2016 |
| KR | 20160079146 | A | 7/2016 |
| KR | 101660347 | B1 | 9/2016 |
| KR | 20160126073 | A | 11/2016 |
| KR | 20160126074 | A | 11/2016 |
| KR | 20160004256 | U | 12/2016 |
| KR | 101693281 | B1 | 1/2017 |
| KR | 20170001743 | A | 1/2017 |
| KR | 101713997 | B1 | 3/2017 |
| KR | 101726280 | B1 | 4/2017 |
| KR | 20170001222 | U | 4/2017 |
| KR | 101761297 | B1 | 7/2017 |
| KR | 20170084313 | A | 7/2017 |
| KR | 101768582 | B1 | 8/2017 |
| KR | 101771206 | B1 | 8/2017 |
| KR | 20170095961 | A | 8/2017 |
| KR | 20170105099 | A | 9/2017 |
| KR | 20170105100 | A | 9/2017 |
| KR | 20170139700 | A | 12/2017 |
| KR | 101814567 | B1 | 1/2018 |
| KR | 101817701 | B1 | 1/2018 |
| KR | 20180010248 | A | 1/2018 |
| KR | 20180017193 | A | 2/2018 |
| KR | 20180017194 | A | 2/2018 |
| KR | 20180017196 | A | 2/2018 |
| KR | 20180017197 | A | 2/2018 |
| KR | 20180030620 | A | 3/2018 |
| KR | 101844912 | B1 | 4/2018 |
| KR | 20180033312 | A | 4/2018 |
| KR | 101855222 | B1 | 5/2018 |
| KR | 101855223 | B1 | 5/2018 |
| KR | 101861140 | B1 | 5/2018 |
| KR | 20180069051 | A | 6/2018 |
| KR | 20180069894 | A | 6/2018 |
| KR | 20180071986 | A | 6/2018 |
| KR | 20180072754 | A | 6/2018 |
| KR | 20180086444 | A | 7/2018 |
| KR | 101900840 | B1 | 9/2018 |
| KR | 20180105275 | A | 9/2018 |
| KR | 101906844 | B1 | 10/2018 |
| KR | 101909949 | B1 | 10/2018 |
| KR | 20180110243 | A | 10/2018 |
| KR | 101921159 | B1 | 11/2018 |
| KR | 20180003187 | U | 11/2018 |
| KR | 20180003188 | U | 11/2018 |
| KR | 20180003197 | U | 11/2018 |
| KR | 20180120253 | A | 11/2018 |
| KR | 20180120254 | A | 11/2018 |
| KR | 20180120815 | A | 11/2018 |
| KR | 20180121607 | A | 11/2018 |
| KR | 20180121984 | A | 11/2018 |
| KR | 20180124165 | A | 11/2018 |
| KR | 20180128480 | A | 12/2018 |
| KR | 101946431 | B1 | 2/2019 |
| KR | 101949900 | B1 | 2/2019 |
| KR | 20190017075 | A | 2/2019 |
| KR | 101953713 | B1 | 3/2019 |
| KR | 101953714 | B1 | 3/2019 |
| KR | 101963674 | B1 | 3/2019 |
| KR | 101964103 | B1 | 4/2019 |
| KR | 101965272 | B1 | 4/2019 |
| KR | 20190037328 | A | 4/2019 |
| KR | 20190038930 | A | 4/2019 |
| KR | 20190040108 | A | 4/2019 |
| KR | 101953711 | B1 | 5/2019 |
| KR | 101978707 | B1 | 5/2019 |
| KR | 101983111 | B1 | 5/2019 |
| KR | 20190001036 | U | 5/2019 |
| KR | 101990944 | B1 | 6/2019 |
| KR | 101992734 | B1 | 6/2019 |
| KR | 102007214 | B1 | 8/2019 |
| KR | 102007215 | B1 | 8/2019 |
| KR | 102007355 | B1 | 8/2019 |
| KR | 200489784 | Y1 | 8/2019 |
| KR | 20190090682 | A | 8/2019 |
| KR | 102018622 | B1 | 9/2019 |
| KR | 102018623 | B1 | 9/2019 |
| KR | 102010940 | B1 | 10/2019 |
| KR | 102030102 | B1 | 10/2019 |
| KR | 102030103 | B1 | 10/2019 |
| KR | 102031600 | B1 | 10/2019 |
| KR | 20190122864 | A | 10/2019 |
| KR | 102041173 | B1 | 11/2019 |
| KR | 20190126159 | A | 11/2019 |
| KR | 20190141227 | A | 12/2019 |
| KR | 200490784 | Y1 | 1/2020 |
| KR | 102074285 | B1 | 2/2020 |
| KR | 200491247 | Y1 | 3/2020 |
| KR | 102101642 | B1 | 4/2020 |
| KR | 102101643 | B1 | 4/2020 |
| KR | 102102243 | B1 | 4/2020 |
| KR | 102121904 | B1 | 6/2020 |
| KR | 20200068710 | A | 6/2020 |
| KR | 102143436 | B1 | 8/2020 |
| KR | 102158115 | B1 | 9/2020 |
| KR | 102175883 | B1 | 11/2020 |
| KR | 102179911 | B1 | 11/2020 |
| KR | 102210212 | B1 | 1/2021 |
| KR | 20210012063 | A | 2/2021 |
| KR | 102270980 | B1 | 6/2021 |
| KR | 102270981 | B1 | 6/2021 |
| KR | 20210080545 | A | 6/2021 |
| KR | 102319738 | B1 | 11/2021 |
| KR | 102319796 | B1 | 11/2021 |
| KR | 102321237 | B1 | 11/2021 |

(56) References Cited

FOREIGN PATENT DOCUMENTS

| | | | |
|---|---|---|---|
| KR | 102328006 | B1 | 11/2021 |
| KR | 102336278 | B1 | 12/2021 |
| KR | 20210156324 | A | 12/2021 |
| KR | 102349191 | B1 | 1/2022 |
| KR | 102383039 | B1 | 4/2022 |
| WO | 02054902 | A2 | 7/2002 |
| WO | 2009077747 | A3 | 10/2009 |
| WO | 2011078593 | A3 | 11/2011 |
| WO | 2012028862 | A1 | 3/2012 |
| WO | 2012080751 | A3 | 9/2012 |
| WO | 2013016583 | A1 | 1/2013 |
| WO | 2013144569 | A1 | 10/2013 |
| WO | 2013144570 | A1 | 10/2013 |
| WO | 2013144571 | A1 | 10/2013 |
| WO | 2013144572 | A1 | 10/2013 |
| WO | 2013144574 | A1 | 10/2013 |
| WO | 2013144575 | A1 | 10/2013 |
| WO | 2013144576 | A1 | 10/2013 |
| WO | 2013171732 | A1 | 11/2013 |
| WO | 2013171750 | A1 | 11/2013 |
| WO | 2014006365 | A1 | 1/2014 |
| WO | 2014006366 | A1 | 1/2014 |
| WO | 2014001770 | A3 | 3/2014 |
| WO | 2014147460 | A8 | 11/2014 |
| WO | 2014201424 | A1 | 12/2014 |
| WO | 2015001303 | A1 | 1/2015 |
| WO | 2015001304 | A1 | 1/2015 |
| WO | 2015001305 | A1 | 1/2015 |
| WO | 2015001306 | A1 | 1/2015 |
| WO | 2015001307 | A1 | 1/2015 |
| WO | 2015001308 | A1 | 1/2015 |
| WO | 2015001310 | A1 | 1/2015 |
| WO | 2015008024 | A1 | 1/2015 |
| WO | 2015011442 | A1 | 1/2015 |
| WO | 2015044644 | A1 | 4/2015 |
| WO | 2015044645 | A1 | 4/2015 |
| WO | 2015087040 | A1 | 6/2015 |
| WO | 2015087043 | A1 | 6/2015 |
| WO | 2015008025 | A3 | 7/2015 |
| WO | 2015140506 | A1 | 9/2015 |
| WO | 2015140507 | A1 | 9/2015 |
| WO | 2015140508 | A1 | 9/2015 |
| WO | 2016072657 | A1 | 5/2016 |
| WO | 2016097682 | A1 | 6/2016 |
| WO | 2016097683 | A1 | 6/2016 |
| WO | 2016113523 | A1 | 7/2016 |
| WO | 2016116728 | A1 | 7/2016 |
| WO | 2016116729 | A1 | 7/2016 |
| WO | 2016189270 | A1 | 12/2016 |
| WO | 2016196916 | A1 | 12/2016 |
| WO | 2016203195 | A1 | 12/2016 |
| WO | 2016203196 | A1 | 12/2016 |
| WO | 2016203197 | A1 | 12/2016 |
| WO | 2016203198 | A1 | 12/2016 |
| WO | 2017009595 | A1 | 1/2017 |
| WO | 2017016865 | A1 | 2/2017 |
| WO | 2017068320 | A1 | 4/2017 |
| WO | 2017068321 | A1 | 4/2017 |
| WO | 2017068322 | A1 | 4/2017 |
| WO | 2017098200 | A1 | 6/2017 |
| WO | 2017098204 | A1 | 6/2017 |
| WO | 2017163003 | A1 | 9/2017 |
| WO | 2017163005 | A1 | 9/2017 |
| WO | 2017163007 | A1 | 9/2017 |
| WO | 2017163066 | A1 | 9/2017 |
| WO | 2017163068 | A1 | 9/2017 |
| WO | 2017187128 | A3 | 12/2017 |
| WO | 2018042154 | A1 | 3/2018 |
| WO | 2018051059 | A1 | 3/2018 |
| WO | 2018051113 | A1 | 3/2018 |
| WO | 2018130798 | A1 | 7/2018 |
| WO | 2018130832 | A1 | 7/2018 |
| WO | 2018162878 | A1 | 9/2018 |
| WO | 2018172734 | A1 | 9/2018 |
| WO | 2018172735 | A1 | 9/2018 |
| WO | 2018206911 | A1 | 11/2018 |
| WO | 2019077301 | A1 | 4/2019 |
| WO | 2020008163 | A1 | 1/2020 |
| WO | 2020055436 | A1 | 3/2020 |
| WO | 2020055519 | A1 | 3/2020 |
| WO | 2020089579 | A1 | 5/2020 |
| WO | 2020257765 | A1 | 12/2020 |
| WO | 2019067716 | A9 | 12/2021 |
| WO | 2022069857 | A1 | 4/2022 |
| WO | 2022069858 | A1 | 4/2022 |
| WO | 2022069859 | A1 | 4/2022 |
| WO | 2022069860 | A1 | 4/2022 |
| WO | 2022069864 | A1 | 4/2022 |
| WO | 2022069865 | A1 | 4/2022 |
| WO | 2022069881 | A1 | 4/2022 |
| WO | 2022162336 | A1 | 8/2022 |
| WO | 2022162337 | A1 | 8/2022 |
| WO | 2022162338 | A1 | 8/2022 |
| WO | 2022162339 | A1 | 8/2022 |
| WO | 2022162340 | A1 | 8/2022 |

OTHER PUBLICATIONS

Clarivate Analytics copyrighted translation of WO2008/139051A2; international filing date Apr. 4, 2008 (Year: 2008).*

Clarivate Analytics copyrighted translation of CN211794793U; publication date Oct. 30, 2020 (Year: 2020).*

Clarivate Analytics copyrighted translation of KR102321237B1; publication date Nov. 3, 2021 (Year: 2021).*

Invitation to Pay Additional Fees received for PCT Application No. PCT/US2024/016926, mailed on Jun. 3, 2024, 21 pages.

International Search Report and Written Opinion received for PCT Application No. PCT/US2024/016926, mailed on Aug. 12, 2024, 35 pages.

* cited by examiner

BRUSH ATTACHMENT FOR HAIR CARE APPLIANCE

FIELD

Attachments are provided for use with hair care appliances.

BACKGROUND

Hair care appliances are devices used for drying and styling of hair. Hair care appliances can include a variety of components operable to provide a fluid flow via a fluid flow path extending through the device. The fluid flow path receives ambient air at an inlet of the hair care appliance and directs the ambient air through the hair care appliance via a motor and fan assembly. The fluid flow path is directed across a heating assembly to generate heated air at an outlet of the hair care appliance. Air is expelled from the hair care appliance via an outlet arranged to enable a user to dry or style hair.

One or more attachments are often used with the hair care appliance depending on the user's hair styling or treatment needs. Attachments can be coupled to the outlet of the hair care appliance and can include additional outlets to arranged to provide the fluid flow path through the attachment.

SUMMARY

In general, an attachment configured for use with a hair care device, such as a hair dryer, for use in drying and/or styling hair is provided. In one aspect, an attachment for a hair care appliance is provided and in one embodiment can include an elongated body having an inner lumen extending therethrough between proximal and distal ends. The body can have an air inlet at the proximal end, a fluid flow path extending from the air inlet through the inner lumen toward the distal end, a plurality of air outlets for allowing air to exit the body, and a plurality of bristles extending from an outer surface of the body. The attachment can also include a baffle disposed within the inner lumen of the body along the fluid flow path. The baffle can be configured to divert air received at the air inlet of the body to the plurality of air outlets.

In one embodiment, the baffle can have a proximal region configured to reduce a volume of fluid flowing along the fluid flow path and to radially distribute the fluid within the body, a distal region downstream of the proximal region configured to increase an air pressure of the fluid along the fluid flow path, and an intermediate region between the proximal and distal regions configured to reduce air pressure provided to the distal region.

In another embodiment, the proximal region of the baffle can have a planar surface orthogonal to the fluid flow path, the distal region of the baffle can have a tapered profile, and the intermediate region of the baffle can have a reduced diameter as compared to the proximal and distal regions.

In another embodiment, the distal region of the baffle can have a hollow interior. In some embodiments, the distal region can taper from a smaller diameter adjacent to the middle portion to a larger diameter at the distal end of the frame. In some embodiments, the intermediate portion can include a plurality of support elements extending longitudinally there along, and the plurality of support elements can be arranged radially around a length of the intermediate portion. In some embodiments, the intermediate portion can have a substantially constant diameter along the entire length thereof.

In other aspects, the body can include a frame and a cover disposed over the frame. The cover can include a metallic coating configured to distribute heat across a surface of the cover. In some embodiments, the plurality of bristles can be mounted on the frame and the cover can include a plurality of openings for receiving the bristles there through.

In another embodiment, the attachment can further include a mating assembly on a proximal end of the body configured to couple the body to a hair care appliance. In some embodiments, the mating assembly can include a first member configured to fixedly attach to a hair care appliance, and a second member can be freely rotatably mated to the first member, and the body can be mounted on the second member. In some embodiments, the attachment can further include an end cap on the distal end of the body.

In another aspect, an attachment for a hair care appliance is provided and in one embodiment can include an elongated body having an inner lumen extending therethrough between proximal and distal ends. The body can have an air inlet at the proximal end, a fluid flow path extending from the air inlet through the inner lumen toward the distal end, a plurality of air outlets for allowing air to exit the body, and a plurality of bristles extending from an outer surface of the body. The attachment can also include a baffle suspended from the distal end of the body and extending within the inner lumen of the body toward the proximal end of the body. The baffle can be disposed along the fluid flow path and can be configured to divert air received at the air inlet to the plurality of air outlets.

In some aspects, the body can include a frame and a cover disposed around the frame. In another embodiment, the plurality of air outlets can include a first plurality of elongate-shaped air outlets oriented parallel to a central longitudinal axis of the body, and a second plurality of elongate-shaped air outlets oriented transverse to the central longitudinal axis of the body. In another embodiment, each of the second plurality of air outlets can be positioned between a pair of the first plurality of air outlets. In some embodiments, the proximal end of the body can include a mating assembly having first member configured to couple to a hair care appliance and second member freely rotatably coupled to the first member, and the body, end cap, and baffle cam be fixedly mated to the second member.

In another aspect, an attachment for a hair care appliance is provided and in one embodiment can include an elongated tubular body including a proximal end and a distal end opposite the proximate end. The body can have a fluid flow path therethrough along a central longitudinal axis extending from the proximal end to the distal end of the body, and the body can have a plurality of outlets therein and a plurality of bristles projecting outward therefrom. The attachment can also include a baffle disposed within the body and configured to divert fluid along the fluid flow path through the plurality of outlets. The attachment can further include a mating assembly coupled to the proximal end of the body. The mating assembly can have a first member configured to be releasably and non-rotatably attached to a hair care appliance, and a second member configured to rotate freely relative to the first member about the central longitudinal axis of the body. The body can be fixedly coupled to and rotatable with the second member.

In another embodiment, the first and second members can be ring shaped and can include a gasket positioned there between for facilitating rotation. In some embodiments, the first member can include a plurality of slots spaced around a circumference thereof and can be configured to receive at least one protrusion on an attachment mating portion of a hair care appliance to couple the mating assembly to the hair care appliance.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary attachments or accessories for use with a hair care appliance, such as a hair dryer, are provided herein. In one embodiment, an attachment in the form of a brush accessory is provided having bristles configured to engage with hair during brushing or styling. The brush attachment can also include outlets configured to divert air flowing from the outlet of the hair care appliance and into the brush attachment so as to provide air via outlets of the brush attachment. In certain embodiments, the air flow can be diverted evenly along the entire length of the brush attachment based on the shaped regions of a baffle provided within the brush attachment. In other aspects, a mating feature is provided to enable an attachment, such as a brush attachment, to rotate relative to the hair care appliance to which it is attached so that a user can rotate the attachment and air flow to apply a desired styling effect more easily.

Advantageously, these features can provide an enhanced styling experience, particularly for curling or brushing hair compared to other attachments for a hair care appliance. The provision of a uniform amount and velocity of air flow along an entire length of an attachment can enhance the performance of the attachment so that the entire length of the attachment can be used to style hair and a greater amount of hair can be styled at one time. Additionally, the rotating use of an attachment can allow a user to direct the air flow to desired portions of their hair more easily than non-rotating attachments, which may only have fixed outlet locations.

Figure 1:
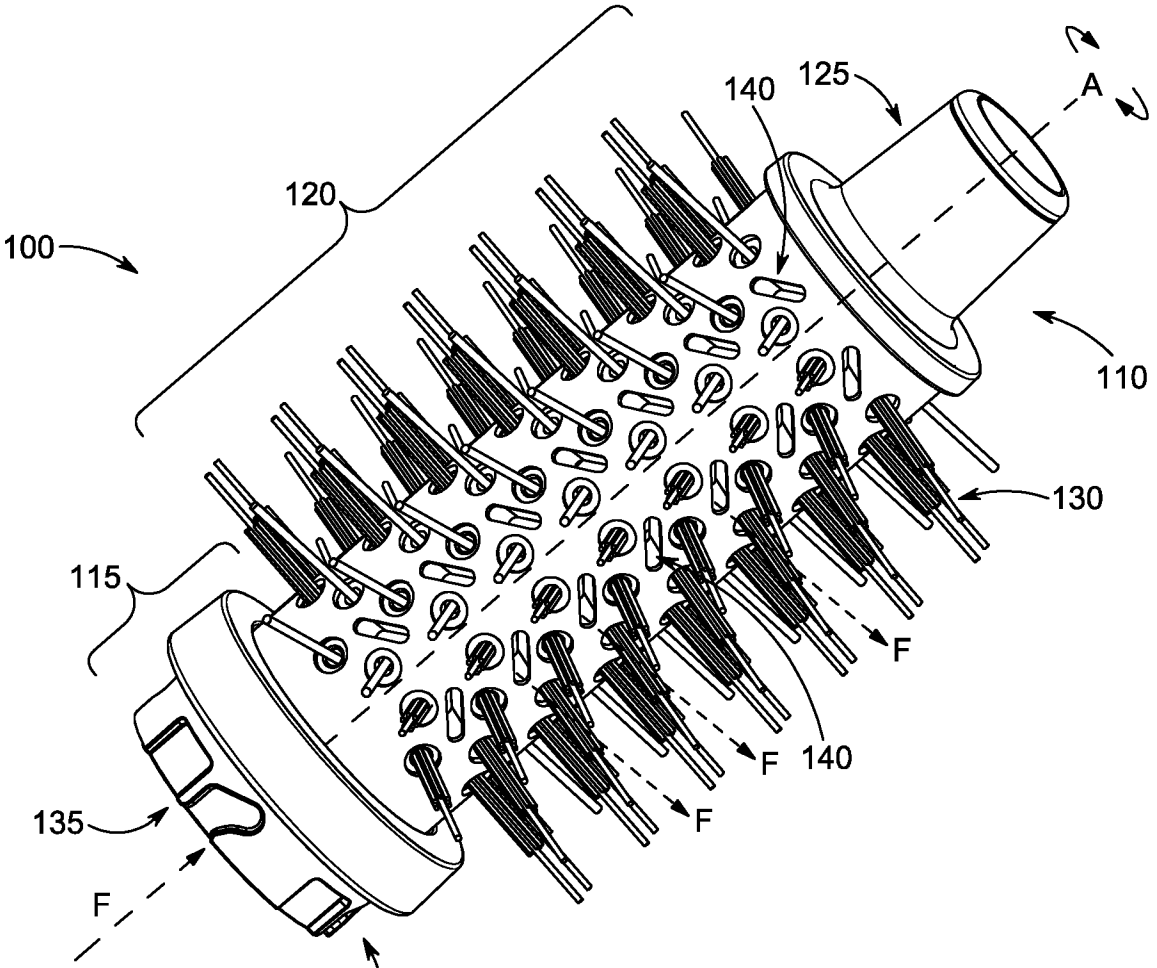
FIG. 1 is a perspective view of one exemplary embodiment of a brush attachment configured for use with a hair care appliance.
Figure 2:
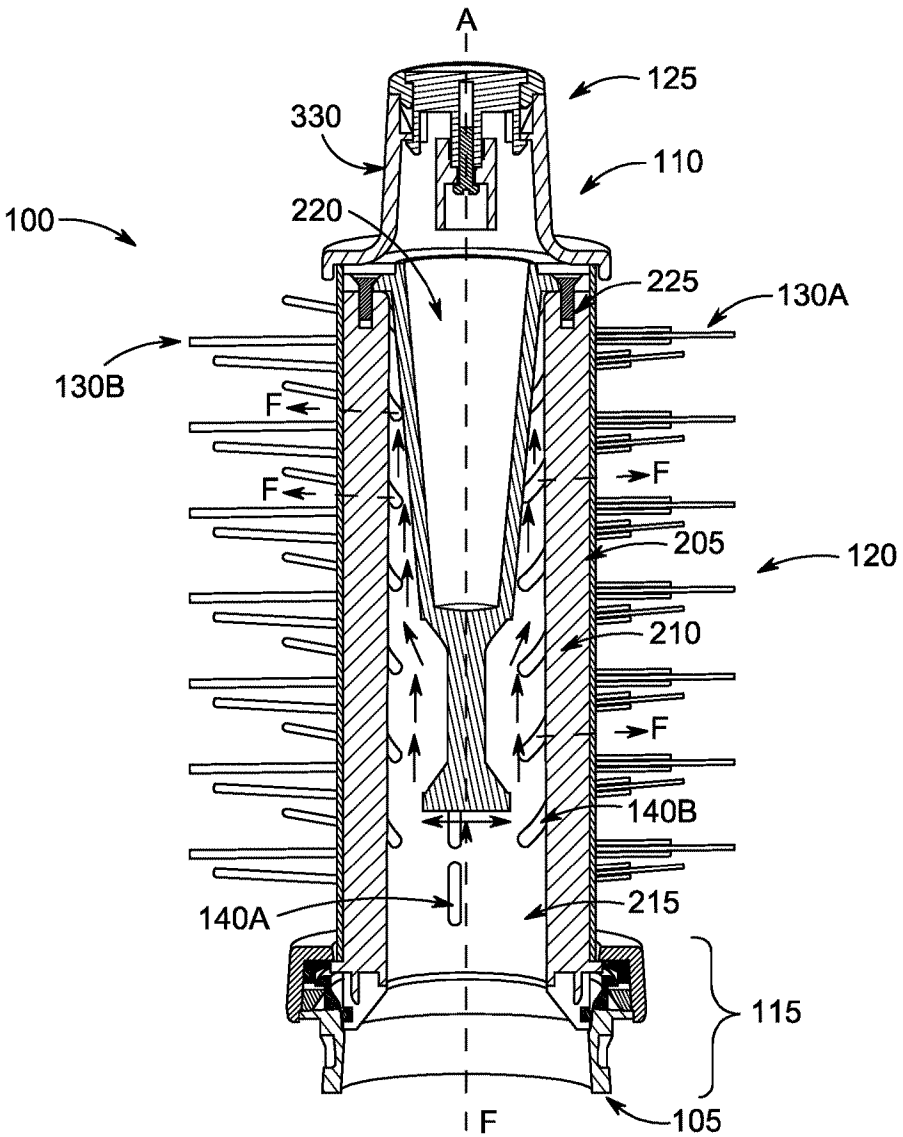
FIG. 2 is a cross-sectional view of the brush attachment of FIG. 1.
Figure 3:
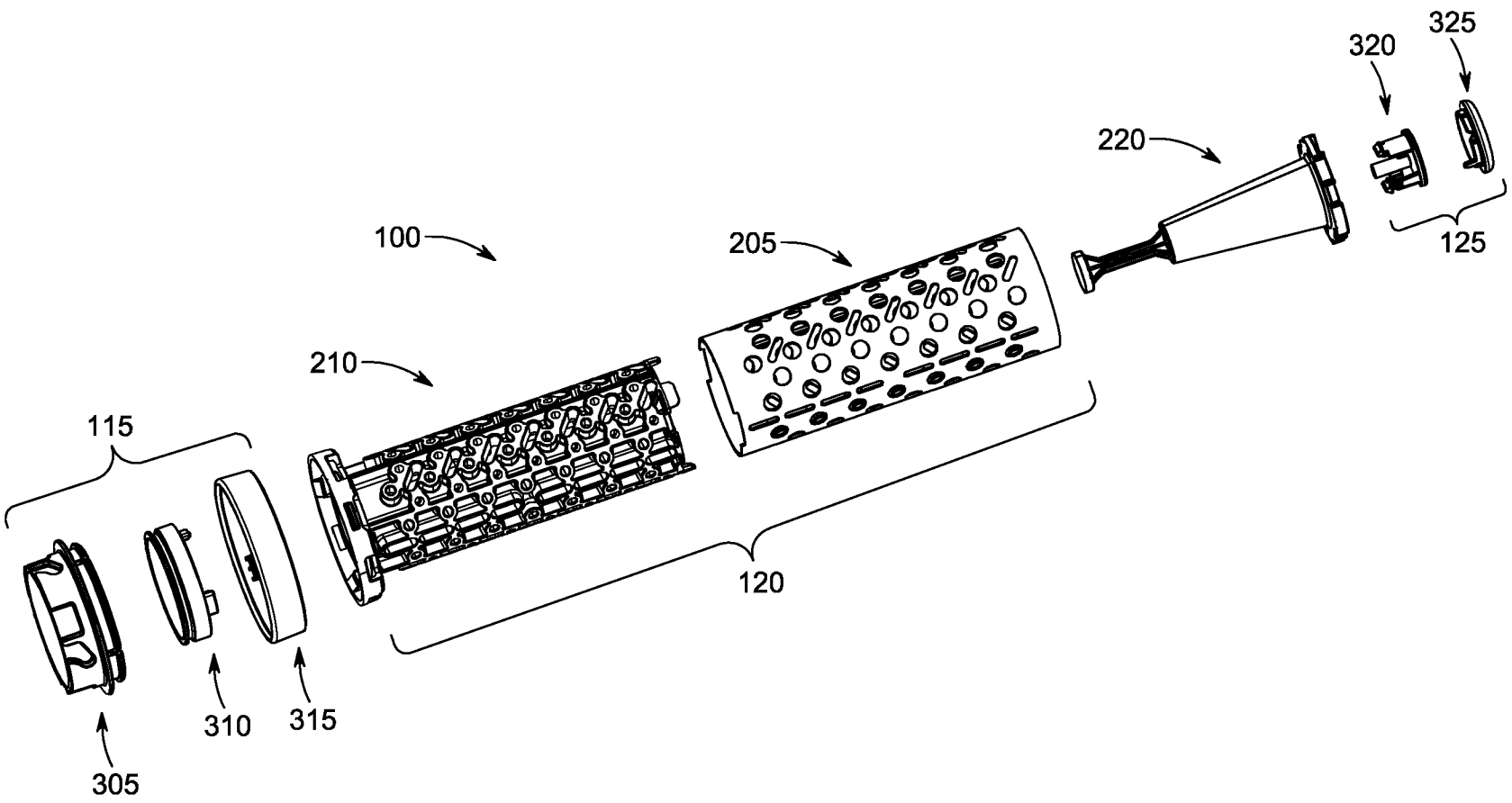
FIG. 3 is an exploded view of the brush attachment of FIG. 1.

FIGS. 1-3 illustrate one exemplary embodiment of an attachment 100. In this embodiment, the attachment 100 is in the form of a brush attachment, however a person skilled in the art will appreciate that the features shown in the figures can be utilized in various other types of attachments, such as curler wands or rods. As shown in FIG. 1, the brush attachment 100 has an elongated cylindrical shape with a proximal end 105 and a distal end 110 having a central axis A extending longitudinally there between. The proximal end 105 can be configured to couple to a hair care appliance via a mating assembly 115 provided thereon. An elongate body 120 can be coupled at the proximal end 105 to the mating assembly 115 and to an end cap 125 at the distal end 110. The elongate body 120 can include a plurality of bristles 130 that can project radially from the body 120. A fluid flow path F can be received at an inlet 135 arranged in an opening at the proximal end 105 of the brush attachment 100. The fluid flow path F can extend through an inner lumen of the body 120 and out of the body 120 via a plurality of outlets 140 arranged on the body 120.

The body 120 of the brush attachment 100 can having a variety of shapes and sizes, and can be formed from various components. In the illustrated embodiment, the body 120 includes a frame 210 having a cover 205 disposed there around, as shown in FIGS. 2 and 3.

Figure 4:
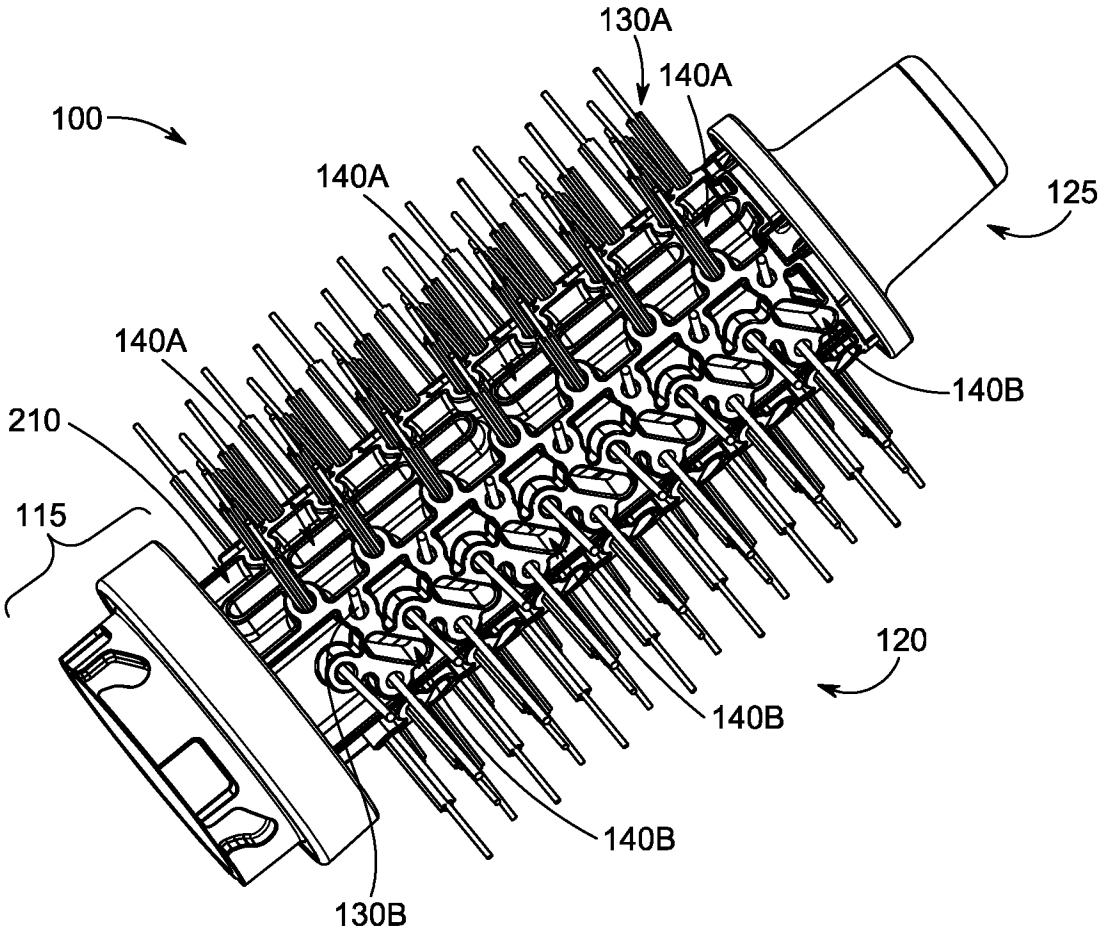
FIG. 4 is a perspective view of the brush attachment of FIG. 1 with the cover removed.
Figure 5:
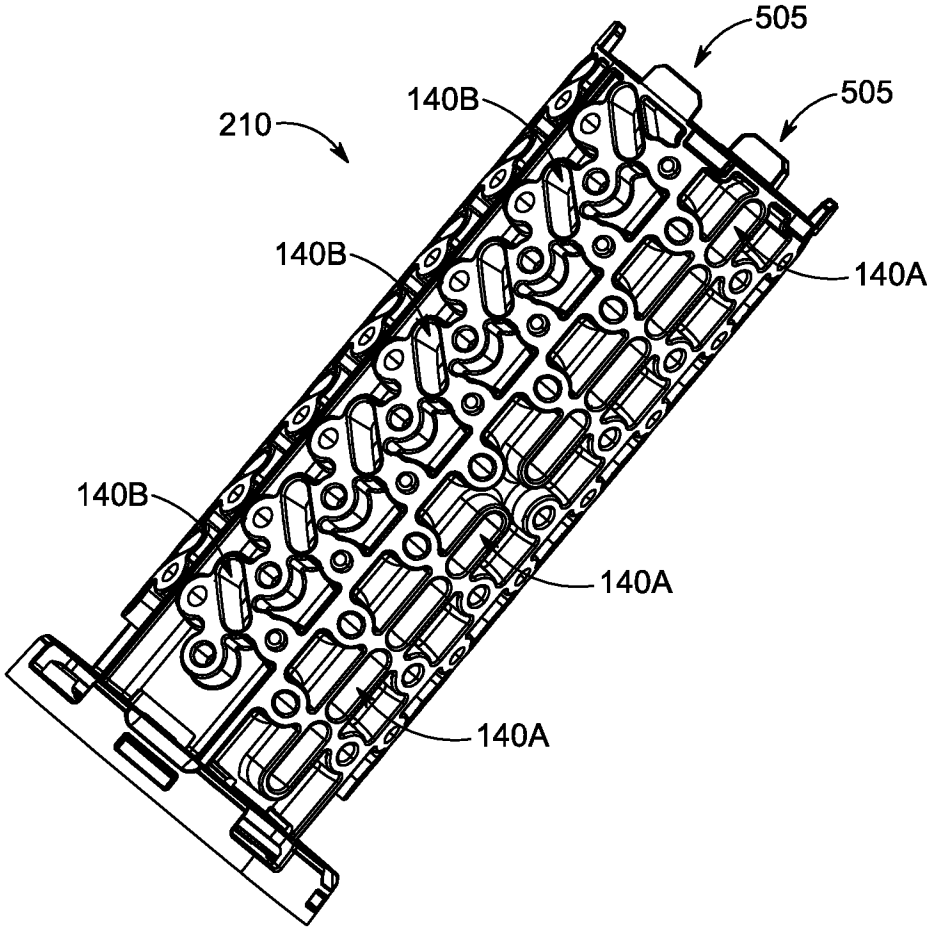
FIG. 5 is a perspective view of a frame of the brush attachment of FIG. 1.

The illustrated frame 210 has an elongate, hollow cylindrical shape with an inner lumen 215 extending there through and defining a fluid flow path F from the inlet 135 at the proximal end 105 of the attachment 100 to a plurality of outlets 140. The plurality of outlets 140 can be formed in the frame 210 at various locations and in various patterns. As shown in FIGS. 2, 4, and 5, the outlets 140 are spaced longitudinally along the frame and radially around the frame. The illustrated outlets 140 include a first plurality of outlets 140A having an elongated shape and arranged longitudinally along the length of the frame 210 parallel to axis A, and a second plurality of outlets 140B having an elongated shaped and arranged longitudinally along the length of the frame 210 at an angle relative to axis A and to the first plurality of outlets 140A. In some embodiments, the second plurality of outlets 140 can be arranged perpendicular to axis A.

The frame 210 can further include a plurality of bristles 130 positioned about a circumference and along the length of the frame 210 and extending radially away from the frame 210. As shown in FIG. 4, a first plurality of bristles 130A can include a set of bristles in which a cluster of shorter bristles surround a longer, central bristle. In some embodiments, the shorter bristles can include an animal hair material, such as boar hair. The bristles can also include a second plurality of bristles 130B having non-clustered, single bristles. In some embodiments, a location of the second plurality of bristles 130B can be arranged between locations of the first plurality of bristles 130A. A non-limiting arrangement of first and second pluralities of bristles 130 can be envisioned.

Figure 6:
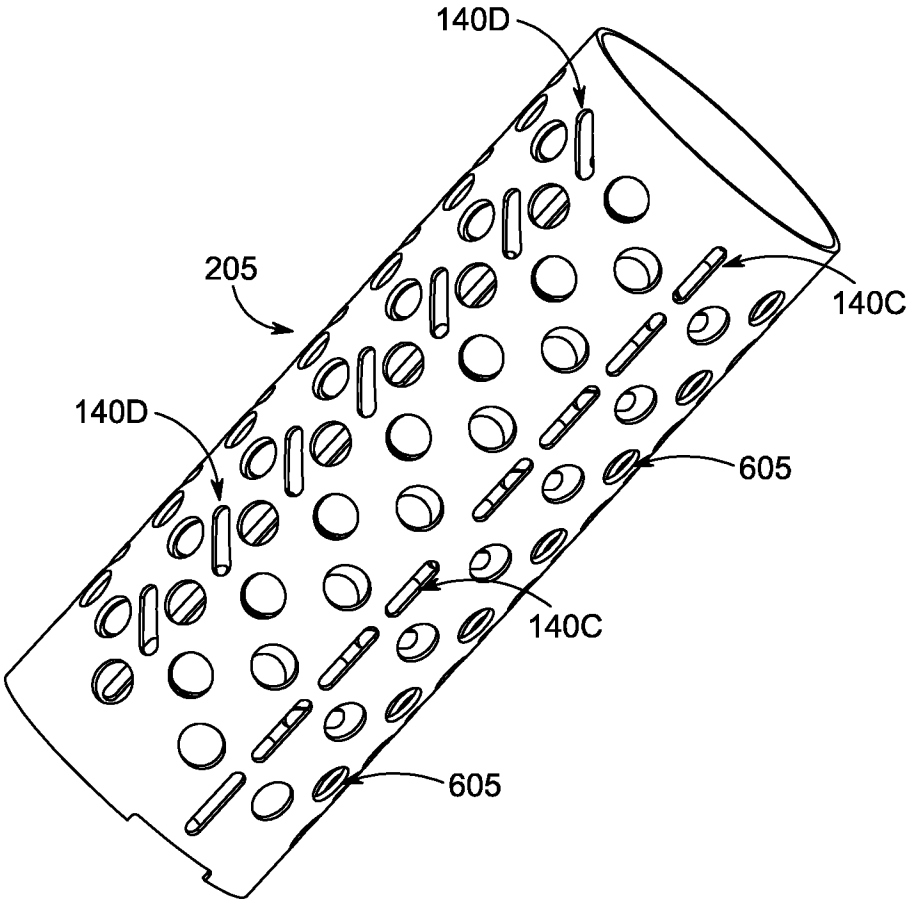
FIG. 6 is a perspective view of a cover of the brush attachment of FIG. 1.

As indicated above, the body 120 can also include a cover 205 positioned over the frame 210. The cover 205 can thus have a size that substantially corresponds to a size of the frame 210 to form a close fit with the frame. As shown in FIG. 6, the cover 205 can include outlets 140C, 140D which can form portions of the outlets 140 through which the fluid flow path F can extend radially from the body 120. The outlets 140C, 140D in the cover 205 can correspond to and align with the outlets 140A, 140B in the frame 210. In particular, the elongate shape and longitudinal arrangement of the outlets 140C can match the shape and arrangement of the first plurality of outlets 140A provided in the frame 210. The angled shape and longitudinal arrangement of the outlets 140D can match the shape and arrangement of the second plurality of outlets 140B that are also provided in the frame 210. When the cover 205 is positioned over the frame 210 in the assembled configuration, as shown in FIG. 2, the outlets 140C and 140D extending through the cover 205 are aligned with outlets 140A and 140B, respectively, that extend through the frame 210. In this way, the outlets 140 can form a fluidic pathway for the fluid flow path to exit from the inner lumen 215 of the frame 210, through the outlets 140A and 140B arranged in the frame 210 before passing through the corresponding outlets 140C and 140D in the cover 205.

As further shown in FIG. 6, the cover 205 can include a plurality of openings 605 through which the plurality of bristles 130 can extend from the frame 210. The cover 205 can be retained in place relative to the frame 210 via the plurality of bristles 130 that extend through the cover 205. In this way, the cover 205 is precluded from rotating separately from the frame 210.

In some embodiments, the cover 205 can include a coating for retaining heat and distributing heat about the cover 205. The coating can be formed from any thermally conductive material, such a metal material. In other embodiments, the cover 205 can be eliminated and the frame can be coated.

As further shown in FIGS. 2 and 3, the frame 210 can include a baffle 220 disposed within the inner lumen 215. The baffle 220 can be configured to engage and direct a fluid flow received from the outlet of the hair care appliance and can distribute the fluid flow throughout the attachment 100. In certain exemplary embodiments, the baffle 220 can have several different shaped regions configured to direct the fluid flow path F through the inner lumen 215 and out of the body 120 through the outlets 140 in a uniform manner along the entire length of the body 120.

Figure 8B:
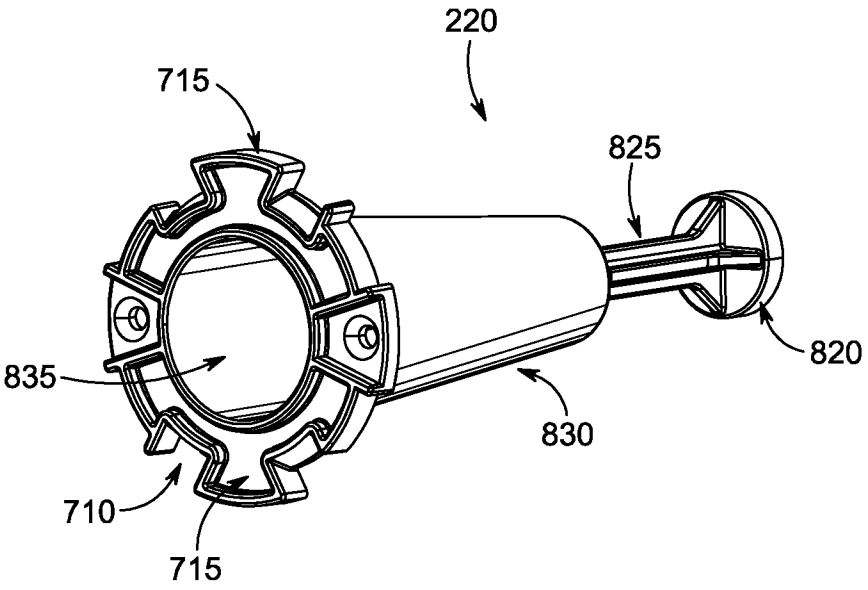
FIG. 8B is a perspective view of a baffle of the brush attachment of FIG. 1 taken from a distal end of the baffle.
Figure 8A:
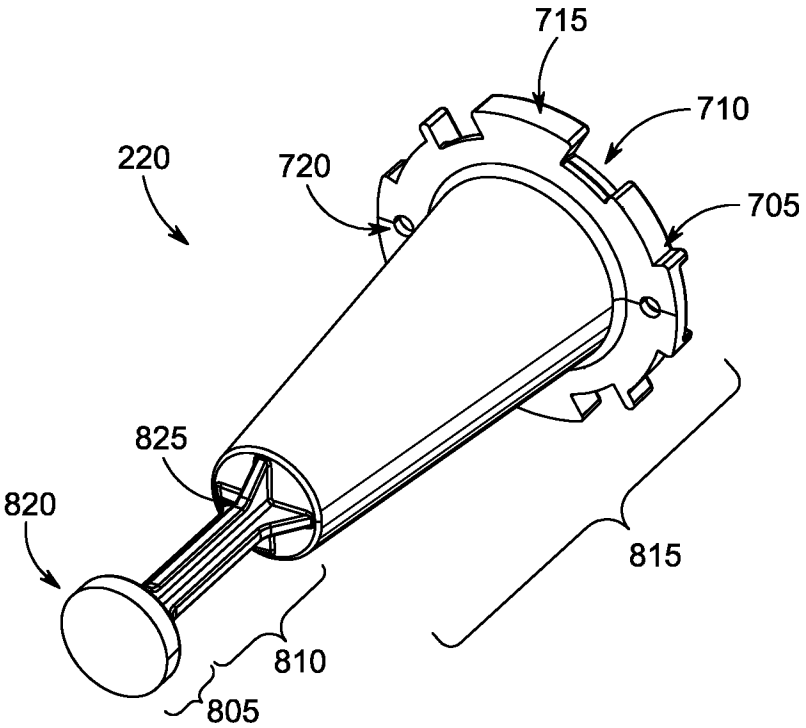
FIG. 8A is a perspective view of a baffle of the brush attachment of FIG. 1 taken from a proximal end of the baffle.

As shown in FIGS. 8A and 8B, the illustrated baffle 220 includes a plurality of regions which have differing shapes and functions, but collectively operate together to provide a consistent, even air flow from the outlets 140 along the entire length of the body 120. In particular, the illustrated baffle 220 has a proximal region 805, an intermediate region 810, and a distal region 815 including a plate 705, discussed further below. The illustrated proximal region 805 has a planar surface 820 that can directly interface with the fluid flow path F within the inner lumen 215. The planar surface 820 is shown as a circular plate-like structure defining a solid disc, although other differently-shaped structures with planar or non-planar surfaces are envisioned. The planar surface 820 can be configured to provide a surface area against which the fluid flow path F is intersected. The fluid flowing along the flow path F can be slowed and redirected radially toward the outlets 140A and 140B in the frame 210 by the planar surface 820.

As further shown in FIGS. 8A and 8B, the baffle 220 can include an intermediate region 810 adjacent to the proximal region 805. The intermediate region 810 can thus be downstream of the proximal region 805 and can include one or more support elements 825. The support elements 825 can be arranged longitudinally between the proximal region 805 and the distal region 815 along a length of the intermediate region 810. The support elements 825 can extend radially from a central portion of the intermediate region 810. The intermediate region 810 can include a smaller diameter than the proximal region 805 and/or the distal region 815. The support elements 825 can provide a rigid support structure for the planar surface 820. In some embodiments, the support elements 825 can include angled abutments to strengthen the coupling of the support elements to the planar surface 820 and the distal region 815.

The distal region 815 can include a frustoconical housing 830 coupled to the support elements 825 of the intermediate region 815. The housing 830 can have a tapered profile including a smaller diameter adjacent to the intermediate region and larger diameter at the distal end of the baffle 220 (e.g., the distal end at which the plate 705 is located). The housing 830 can have a hollow interior 835 for weight reduction of the baffle. The tapered profile of the housing 830 can advantageously increase air pressure of fluid flowing along the fluid flow path F adjacent to the distal region of the baffle 210. As a result, fluid reaching the distal region 815 of the baffle 210 can be conveyed through the outlets 140 at the same velocity and volume as fluid exiting the outlets 140 arranged adjacent to the intermediate region 810 and the proximal region 805. This design can thus provide a consistent volume and velocity of fluid from the brush attachment 100 along its entire length.

Figure 7:
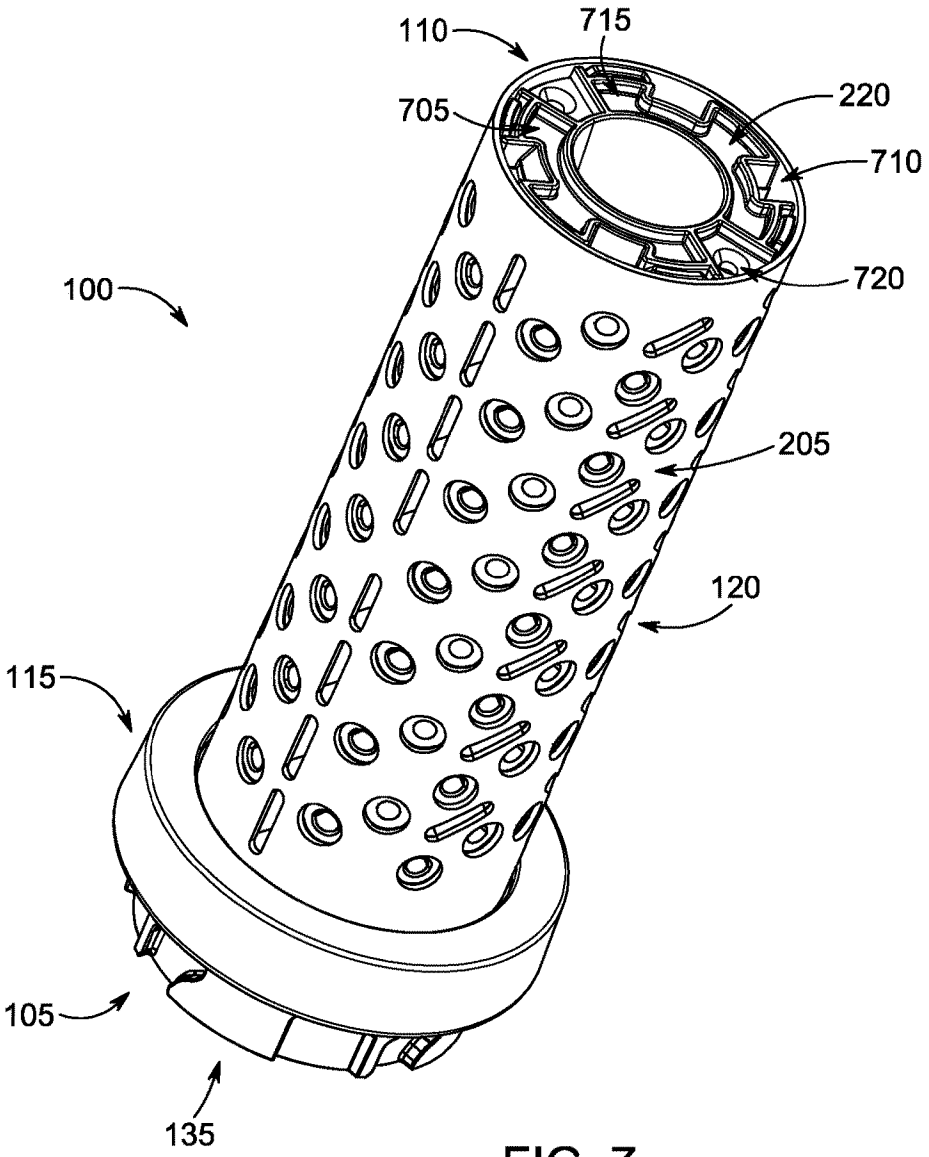
FIG. 7 is a perspective view of the brush attachment of FIG. 1 with the end cap removed.

In order to mount the baffle 220 to the frame 210, the baffle 220 can have a frame mounting plate 705 at a distal end thereof, as shown in FIGS. 7-8B. The frame mounting plate 705 can include a plurality of slots 710 arranged around a circumference of the plate 705 and positioned between segments 715 of the plate 705. The number and arrangement of the slots 710 and the segments 715 can vary and is not limited to the arrangement shown in FIG. 7. The slots 710 can be positioned to receive corresponding tabs 505 projecting from the distal end of the frame 210, as shown in FIG. 5. The tabs 505 can be received within the slots 710 to secure the baffle 220 to the frame 210 and prevent rotation of the baffle 220 within the frame 210. When assembled, the distal end of the baffle 220 is secured to the distal end of the frame 210, and the remainder of the baffle 220 extends through the inner lumen of the frame 210 without any additional contact with the frame 210.

Referring back to FIGS. 2 and 3, the brush attachment 100 can also include an end cap 125 at the distal end 110 thereof. The illustrated end cap 125 includes an attachment frame 320, a trim ring 325, and a housing 330. The attachment frame 320 can be secured within the housing 330. The trim ring 325 can be secured in place by insertion of the attachment frame 320 within the housing 330. In use, the end cap 125 can be rotated causing rotation of the body 120 relative to the mating assembly 115, discussed below. By rotating the end cap 125, the user can engage the bristles 130 and the outlets 140 with a greater amount of hair as compared to a non-rotating brush attachment.

Figure 9:
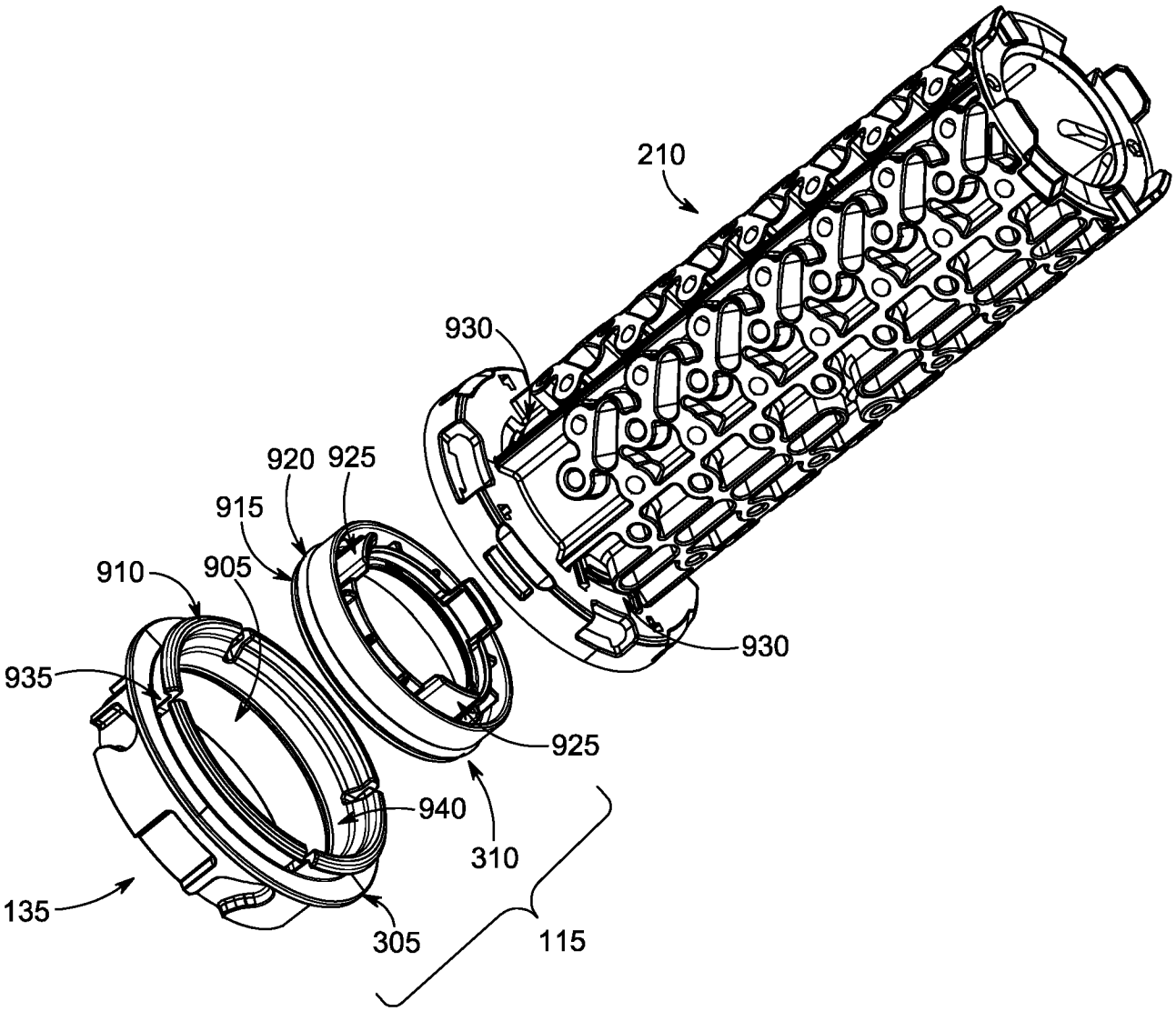
FIG. 9 is an exploded view of a mating assembly coupled to the frame of FIG. 5 with the mating assembly cover removed.

As previously indicated, a mating assembly for rotatably mating an attachment to a hair care appliance is also provided. While the mating assembly is disclosed in connection with brush attachment 100, the mating assembly can be utilized with any type of accessory. FIG. 9 illustrates one embodiment of a mating assembly 115 for mounting the brush attachment 100 to a hair care appliance. The mating assembly 115 can be removably coupled to an outlet of the hair care appliance and can direct air flow from the outlet into the brush attachment 100. The mating assembly 115 can also enable the body 120 to rotate about the axis A as shown in FIG. 1.

In the exploded view of the brush attachment 100 shown in FIG. 3, the mating assembly 115 includes an appliance mating portion 305, a rotating portion 310, and a cover 315. The appliance mating portion 305 can be configured to removably couple with a hair care appliance at an outlet thereof. The appliance mating portion 305 can be fixed relative to the hair care appliance once it is coupled thereto. The rotating portion 310 can be positioned within the appliance mating portion 305 and can be configured to rotate therein. The frame 210 can couple with the rotating portion 310 and a cover 315 can surround the proximal end of the frame 210 where it is coupled to the rotating portion 310. The cover 315 can prevent a user's hands, fingers, or hair from being pinched by rotating elements of the mating assembly 115.

In FIG. 9, the covers 205 and 315 have been removed. As shown, the appliance mating portion 305 is in the form of an annular structure, with an opening 905 therethrough to allow the fluid flow path F to be received within the attachment 100. The opening can form the inlet 135 of the attachment 100. The appliance mating portion 305 can include a collar 910 surrounding the opening 905. The collar 910 can include a plurality of slots 935 formed in the circumference of the collar 910. The slots 935 can be configured to create flexion within the collar 910 when the rotating portion 310 is seated within the collar 910 of the appliance mating portion 305. The appliance mating portion 305 can also include an annular protrusion 940 extending about a circumference of the inner wall of the attachment mating portion. The protrusion 940 can abut the proximal end of the rotating portion 310 when the rotating portion is seated within the appliance mating assembly 305 to prevent the rotating portion from sliding deeper into the opening 905. The coupling of the appliance mating portion 305 with the hair care appliance will be described in more detail later.

The rotating portion 310 of the mating assembly 115 can be received within the appliance mating portion 305. For example, the proximal end 915 of the rotating portion can be received within the opening 905 and abut the protrusion 940 of the appliance mating portion 305. The proximal end can include a gasket 920, such as an o-ring or the like, configured to allow the rotating portion 310 to rotate within the appliance mating portion 305. The rotating portion 310 can couple to the frame 210 via one or more tabs 925 which can project away from the proximal end 915 of the rotating portion 310 and toward the frame 210. The tabs 925 can be received within slots 930 provided in the proximal end of the frame 210. The tabs 925 can include engagement features such as protrusions, detents, or angled face portions which, when received within the slots 930, can secure the rotating portion 310 to the frame 210. A variety of coupling or engagement mechanisms can be envisioned to join the rotating portion 310 and the frame 210 and is not limited to tabs and slots. In some embodiments, the coupling or engagement mechanisms of the rotating portion 310 and the frame 210 can include a friction fit, magnets, rivets, screws, protrusions, grooves, or the like. The coupling of the rotating portion 310 and the frame 210 can enable the attachment 100 to rotate freely when the proximal end 135 of the attachment 100 is coupled to a hair care attachment 100. The appliance mating portion 305 can be releasably secured to the outlet end of a hair care appliance and the attachment 100 can rotate freely relative to the hair care appliance when attached.

Figure 10:
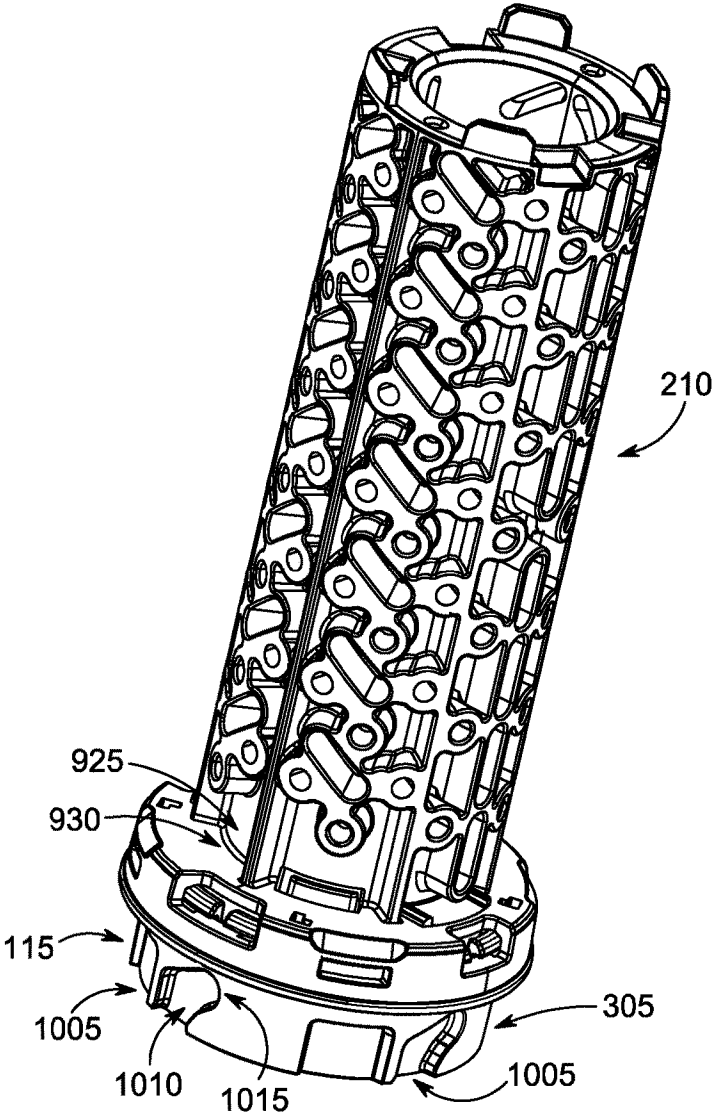
FIG. 10 is a perspective view of the mating assembly coupled to the frame of FIG. 9 with the mating assembly cover removed.

When fully assembled, the attachment mating assembly 115 can couple with the frame 210, as shown in FIG. 10. The appliance mating portion 305 can include one or more slots 1005. The slots 1005 can include an opening 1010 and a receiving end 1015. Protrusions of the attachment mating assembly of a hair care appliance can be inserted into the openings 1010 of the slots 1005 as a user attaches the attachment 100 to the hair care appliance.

Figure 11:
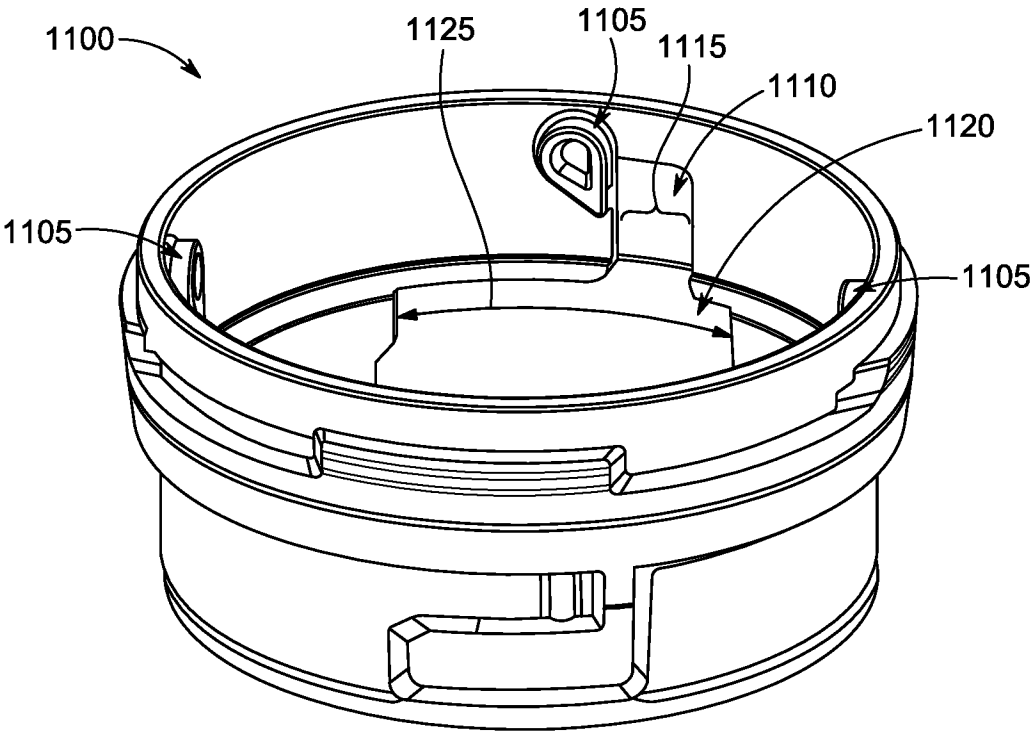
FIG. 11 is a perspective view of an attachment mating assembly of a hair care appliance configured to couple with the mating assembly of FIG. 9.

The outlet end of the hair care appliance can include an attachment mating portion 1100, as shown in FIG. 11, configured to receive and couple with the appliance mating portion 305 of the mating assembly 115. The attachment mating portion 1100 can include one or more protrusions 1105 on an inner surface of the attachment mating portion 1100. The protrusions 1105 can be received within the openings 1010 of the slots 1005 and can travel to the receiving end 1015 as the user rotates the attachment 100 onto the outlet end of the hair care appliance.

The attachment mating portion 1100 can also include at least one recession 1110 configured to receive a tab or protruding portion of an attachment actuator assembly of the hair care appliance. The recession 1110 can have a width 1115 corresponding to a width of the tab or protruding portion of the attachment actuator assembly. As the attachment 100 is mated with the attachment mating portion 1100, the protrusions 1105 can travel into the slots 1005 configured on the appliance mating portion 305 of the attachment. Once travel is complete the user can release a latch of the attachment actuator assembly so that the tab portion of the attachment actuator assembly travels into the recession 1110 locking the attachment in place to prevent rotation of the attachment 100 on the hair care appliance. The attachment mating portion 1100 can also include an opening 1120 along the circumference of the bottom portion of the attachment mating portion 1100. The opening 1120 can receive the attachment actuator assembly therein. The opening 1120 can have a width 1125 corresponding to a width of the attachment actuator assembly.

Figure 12B:
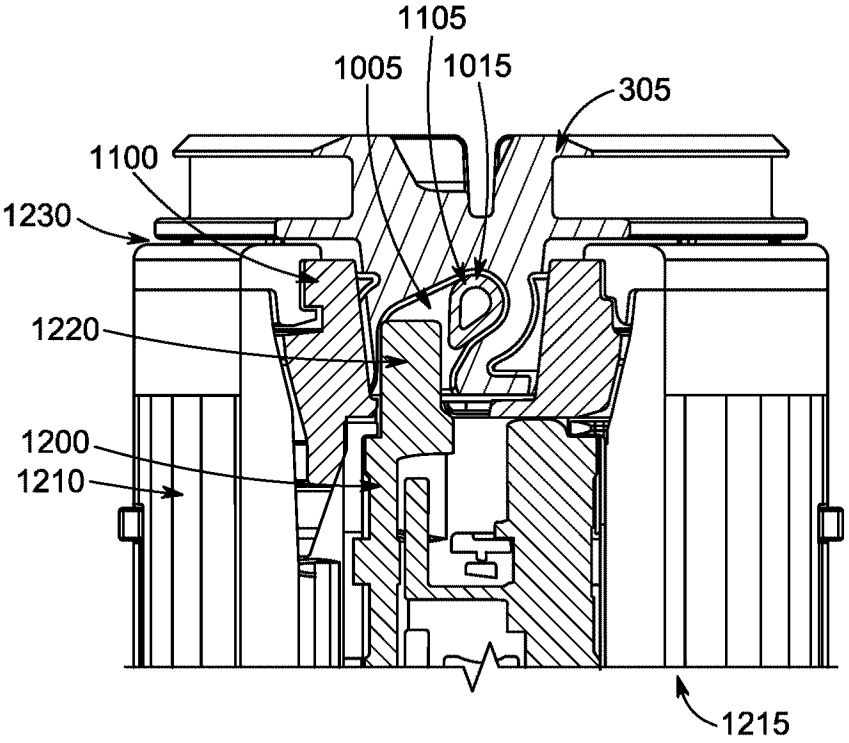
FIG. 12B is a cross-sectional view of a portion of the attachment mating assembly of FIG. 10 coupled with the mating assembly of FIG. 9.
Figure 12A:
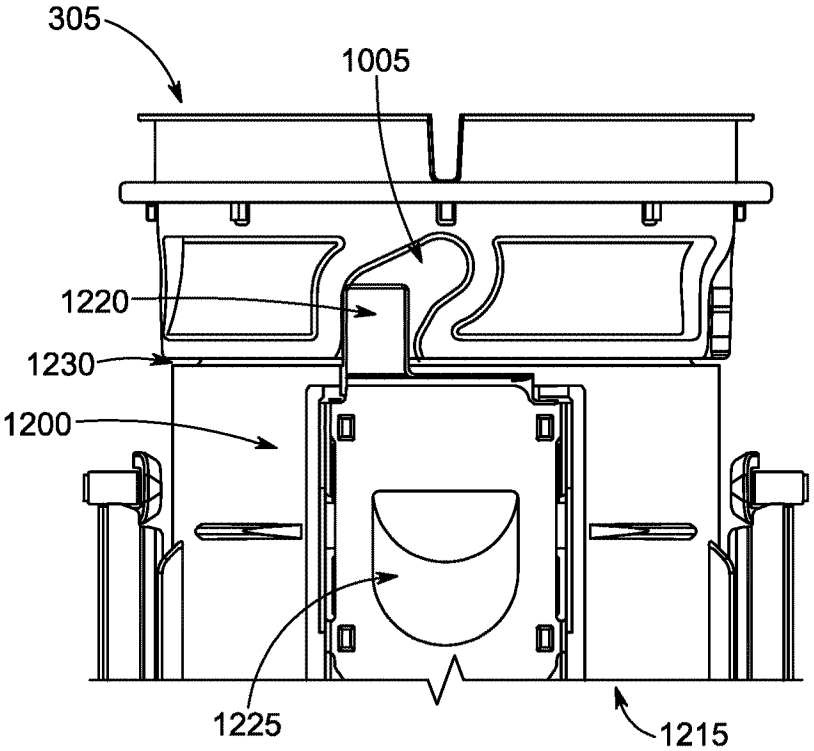
FIG. 12A is a side view of the attachment mating assembly of FIG. 10 coupled with the mating assembly of FIG. 9.

The attachment actuator assembly 1200 of the hair care appliance can be seen in more detail in FIGS. 12A and 12B, showing the attachment actuator assembly 1200 engaged with the appliance mating portion 305 of the attachment 100 according to embodiments described herein. As shown in FIG. 12A, the body 1210 of the hair care appliance 1215 has been removed for illustration and the exterior of the appliance mating portion 305 can be viewed. As discussed above, the slots 1005 can include an opening 1010 at which the protrusions 1105 and a tab 1220 can be received. When the protrusions 1105 reach the receiving end 1015, the user can release the latch 1225 causing the tab 1220 to travel toward the outlet end 1230 of the hair care appliance 1215 and to become positioned within the opening 1120 and the slot 1110. In this way, the tab 1220 can fill a portion of the slot 1110 such that the protrusion 1105 is blocked from rotating away from or out of the receiving end 1015. As a result, the attachment 100 can be secured to the body 1210 and rotation of the attachment 100 relative to the body 1210 is significantly reduced or eliminated. Retracting the latch 1225 can cause the tab 1220 to travel out of the slot 1110 and as the user rotates the attachment 100 for removal from the body 1210, the protrusions 1105 can travel from the receiving end 1015 to the opening 1010 of the slots 1005 to allow uncoupling the attachment 100 from the body 1210 of the hair care appliance 1215.

In FIG. 12B, a cut-away view of the attachment actuator assembly 1200 engaged with the appliance mating portion 1100 is shown. The cut-away view shows an internal perspective of the attachment actuator assembly 1200 engaged with the appliance mating portion 305, as well as the protrusions 1105 engaged with the appliance mating portion 305. The user has rotated the appliance mating portion 305 into contact with the attachment mating portion 1100 such that the protrusions 1105 have traveled into a receiving end 1015 located at a terminal end of the slot 1005 as shown in FIG. 12B. Once the protrusions 1105 are engaged fully within the slot 1005, the user can release the latch 1225 causing the tab 1220 to extend or travel into the slot 1005 to fully secure the appliance mating portion 1100 (and thus, the attachment 100) to the attachment mating portion 1100 of the hair care appliance 1215. In some embodiments, the tab 1220 can be received within the recess 1110 of the appliance mating portion 1100 and the protrusions 1105 can be received within the openings 1010. Rotation of the attachment 100 relative to the body 1210 can thus be reduced or eliminated.

In use, the attachment 100 can be used to dry, brush, curl, or otherwise style hair by coupling the attachment 100 to a hair care appliance and engaging the attachment 100 with the user's hair. The hair care appliance can generate air flow that is received at the inlet 135 of the attachment 100 and directed through the outlets 140 in a uniform, consistent, and even flow along the entire length of the attachment 100. A user can hold the hair care appliance coupled with the attachment 100 attached thereto in one hand and can grasp the end cap 125 in the other hand. When applying a curling styling technique, the user can bring the attachment 100 into contact with their hair and can rotate the end cap 125 so as to rotate the attachment 100 relative to the hair care appliance such that the user's hair is wrapped around the attachment 100. The even, consistent air flow provided along the entire length of the attachment 100 can advantageously allow the user to effectively curl a larger amount of hair and create a more well-formed, circular or helix-shaped curl than other styling attachments. The user can leave their hair wrapped around the attachment 100 for a period of time to set a curl in the wrapped hair. At the end of a period of time, the user can rotate the end cap, and thus the attachment 100, in the opposite direction to release the hair from the attachment 100. When applying a brushing styling technique, the user can bring the attachment 100 into contact with their hair and can maintain the end cap 125 in a fixed position, thereby eliminating or reducing rotation of the attachment 100. The user can bring the attachment 100 into contact with their hair and pull down away from the top of their head so that the air flow provided along the length of the attachment 100 engages with their hair during each brush stroke. The user can repeatedly brush their hair in this manner to dry wet hair or brush wet or dry hair. Because the air flow is provided along the entire length of the attachment 100 in an even, consistent distribution, a greater amount of hair can be dried and the time to dry wet hair can be reduced compared to other attachments.

The improved brush attachments described herein and configured for use with a hair care appliance produce a number of advantages. For example, the rotating body of the brush attachment can rotate relative to the hair care appliance to which it is coupled thereby allowing a user to more efficiently curl a greater quantity of hair than non-rotating brush attachments. As a result, the time required to curl hair can be reduced and more defined, cylindrical shaped curls can be achieved. Additionally, the baffle within the brush attachment can deliver an even volume of air flow along the length of the curling attachment. For example, the proximal region of the baffle can intersect the fluid flow path received at the inlet of the brush attachment to direct the air flow radially toward the surface of the attachment. The tapered, frustoconical shape of the distal region of the baffle can increase air pressure of the fluid flow as it passes toward the distal end of the baffle to ensure air is uniformly directed toward the outlets at the distal end of the attachment. The distal region of the baffle can be hollow to provide an attachment of reduced weight that is easier for a user to handle.

As used herein, the term "proximal" can define a location of an element that is upstream of the fluid flow path F and thus closer in proximity to the outlet of a hair care appliance to which the attachment 100 can be coupled. The term proximal can also refer to a location that is closer to a handle of the hair care appliance at which the user may grasp the hair care appliance. The term "distal" can define a location of an element that is downstream of the fluid flow path F and thus further away from the outlet of the hair care appliance. A distal location will be opposite a proximal location and vice versa. The term distal can also refer to a location that is farther away from the handle of the hair care appliance.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. An attachment for a hair care appliance, comprising:

an elongated body having an inner lumen extending therethrough between proximal and distal ends thereof, the elongated body having an air inlet at the proximal end, a fluid flow path extending from the air inlet through the inner lumen toward the distal end, a plurality of air outlets for allowing air to exit the elongated body, and a plurality of bristles extending from an outer surface of the elongated body; and a baffle disposed within the inner lumen of the elongated body along the fluid flow path, the baffle being configured to divert air received at the air inlet of the elongated body to the plurality of air outlets, the baffle having a proximal region including a planar surface portion positioned distal of the proximal end and spaced centrally within the inner lumen and radially inward from an inner surface of the elongated body, the planar surface portion configured to reduce a volume of fluid flowing along the fluid flow path and to radially distribute the fluid within the body, a distal region downstream of the proximal region configured to increase an air pressure of the fluid along the fluid flow path, and an intermediate region extending from the planar surface portion toward the distal region and configured to reduce air pressure provided to the distal region.

2. The attachment of claim 1, wherein the planar surface portion is positioned orthogonal to the fluid flow path, the distal region of the baffle has a tapered profile, and the intermediate region of the baffle has a reduced diameter as compared to the proximal and distal regions.

3. The attachment of claim 1, wherein the distal region of the baffle has a hollow interior.

4. The attachment of claim 1, wherein the distal region tapers from a smaller diameter adjacent to the intermediate region to a larger diameter at the distal end of the elongated body.

5. The attachment of claim 1, wherein the intermediate region includes a plurality of support elements extending longitudinally there along, the plurality of support elements being arranged radially around a length of the intermediate region.

6. The attachment of claim 1, wherein the intermediate region has a substantially constant diameter along the entire length thereof.

7. The attachment of claim 1, wherein the elongated body comprises a frame and a cover disposed over the frame.

8. The attachment of claim 7, wherein the cover includes a metallic coating configured to distribute heat across a surface of the cover.

9. The attachment of claim 7, wherein the plurality of bristles are mounted on the frame and the cover includes a plurality of openings for receiving the bristles there through.

10. The attachment of claim 1, further comprising a mating assembly on a proximal end of the elongated body configured to couple the elongated body to a hair care appliance.

11. The attachment of claim 10, wherein the mating assembly includes a first member configured to fixedly attach to a hair care appliance, and a second member freely rotatably mated to the first member, the elongated body being mounted on the second member.

12. The attachment of claim 1, further comprising an end cap on the distal end of the elongated body.

13. An attachment for a hair care appliance comprising:

an elongated body having an inner lumen extending therethrough between proximal and distal ends thereof, the elongated body having an air inlet at the proximal end, a fluid flow path extending from the air inlet through the inner lumen toward the distal end, a plurality of air outlets for allowing air to exit the elongated body, and a plurality of bristles extending from an outer surface of the elongated body; and a baffle suspended from the distal end of the elongated body, the baffle including a conical distal portion extending within the inner lumen of the elongated body toward the proximal end of the elongated body, a planar proximal portion having a solid disc spaced apart from the proximal end of the elongated body and having a first diameter, and an intermediate portion having a second diameter less than the first diameter and extending between the conical distal portion and the solid disc so as to suspend the solid disc centrally within the inner lumen, the baffle being disposed along the fluid flow path and being configured to divert air received at the air inlet to the plurality of air outlets.

14. The attachment of claim 13, wherein the elongated body comprises a frame and a cover disposed around the frame.

15. The attachment of claim 13, wherein the plurality of air outlets comprises a first plurality of elongate-shaped air outlets oriented parallel to a central longitudinal axis of the elongated body, and a second plurality of elongate-shaped air outlets oriented transverse to the central longitudinal axis of the elongated body.

16. The attachment of claim 15, wherein each of the second plurality of air outlets is positioned between a pair of the first plurality of air outlets.

17. The attachment of claim 13, wherein the proximal end of the elongated body includes a mating assembly having a first member configured to couple to a hair care appliance and a second member freely rotatably coupled to the first member, and wherein the elongated body, an end cap, and the baffle are fixedly mated to the second member.

18. An attachment for a hair care appliance comprising:

an elongated tubular body including a proximal end and a distal end opposite the proximate end, the elongated tubular body having a fluid flow path therethrough along a central longitudinal axis extending from the proximal end to the distal end of the elongated tubular body, and the elongated tubular body having a plurality of outlets therein and a plurality of bristles projecting outward therefrom;

a baffle disposed within the elongated tubular body configured to divert fluid along the fluid flow path through the plurality of outlets, the baffle including a conical distal portion, a planar proximal portion spaced apart from the proximal end and having a solid disc-shaped diverter aligned with the central longitudinal axis and spaced radially inward from an inner surface of the elongated tubular body, and an intermediate portion extending between the conical distal portion and the solid disc-shaped diverter, wherein the intermediate portion has a diameter less than that of the solid disc-shaped diverter and of the conical distal portion; and a mating assembly coupled to the proximal end of the body, the mating assembly having a first member configured to be releasably and non-rotatably attached to a hair care appliance, and a second member positioned radially within the first member and configured to rotate freely relative to the first member about the central longitudinal axis of the body, the body being fixedly coupled to and rotatable with the second member.

19. The attachment of claim 18, wherein the first and second members are ring shaped and include a gasket positioned there between for facilitating rotation.

20. The attachment of claim 18, wherein the first member includes a plurality of slots spaced around a circumference thereof and configured to receive at least one protrusion on an attachment mating portion of a hair care appliance to couple the mating assembly to the hair care appliance.

* * * * *